US007197425B2

(12) United States Patent
Masuyama et al.

(10) Patent No.: US 7,197,425 B2
(45) Date of Patent: Mar. 27, 2007

(54) ROAD SURFACE STATE ESTIMATING SYSTEM AND ROAD SURFACE STATE MEASURING APPARATUS

(75) Inventors: Yukiei Masuyama, Saitama (JP); Junnosuke Katayama, Tochigi (JP); Noritsugu Kusakari, Tokyo (JP)

(73) Assignee: Seikitokyukogyo Co. Ltd., Tokyo (JP)

( * ) Notice: Subject to any disclaimer, the term of this patent is extended or adjusted under 35 U.S.C. 154(b) by 0 days.

(21) Appl. No.: 11/217,353

(22) Filed: Sep. 2, 2005

(65) Prior Publication Data

US 2005/0288891 A1 Dec. 29, 2005

(30) Foreign Application Priority Data

Sep. 3, 2004 (JP) ..... 2004-256715

(51) Int. Cl.
*G01B 5/02* (2006.01)
*G01B 5/14* (2006.01)

(52) U.S. Cl. ..... 702/158; 702/167; 340/436

(58) Field of Classification Search ..... 702/158, 702/166, 167; 340/435, 436, 437, 438
See application file for complete search history.

(56) References Cited

U.S. PATENT DOCUMENTS 6,023,220 A * 2/2000 Dobler et al. ..... 340/440

FOREIGN PATENT DOCUMENTS

JP 2000-131043 5/2000

JP 2002-303514 10/2002

OTHER PUBLICATIONS

A Study of the Relationship between Surface Texture and Tire/Road Noise of Porous Asphalt Pavement, Journal of Pavement Engineering, vol. 7, pp. 1-1 to 1-6, 2002, The Japan Society of Civil Engineers (JSCE).

Predict of Tire/Road Noise from Road Surface Properties, Journal of Pavement Engineering, vol. 7, pp. 2-1 to 2-9, 2002, The Japan Society of Civil Engineers (JSCE).

* cited by examiner

*Primary Examiner*—John Barlow
*Assistant Examiner*—Meagan S Walling
(74) *Attorney, Agent, or Firm*—Armstrong, Kratz, Quintos, Hanson & Brooks, LLP.

(57) ABSTRACT

Provided is a road surface state estimating system for carrying out measuring along a plurality of measuring lines on a paved road surface, which improves the reliability of texture estimation of the road surface. A road surface state estimating system (1) includes a laser displacement meter (11) for measuring a distance to the road surface, a stepping motor (120A), rails (12A and 12B), a ball screw (121A), and mounting members (13A and 13B) for causing the laser displacement meter (11) to scan along the measuring lines, and a stepping motor (130), a rail (13), a ball screw (131), and a mounting member (11A) for moving the laser displacement meter (11) in a direction orthogonal to the measuring lines, which allows the laser displacement meter (11) to carry out measurement along the plurality of measuring lines while it is translated two-dimensionally. By determining a mean value of a plurality of texture scores such as MPDs calculated from the result of the measurement along the plurality of measuring lines, the reliability of the texture estimation is improved.

14 Claims, 15 Drawing Sheets

| | MEAN VALUE OF MEAN VALUE MPDS (mm) | COEFFICIENT OF VARIATION OF MEAN VALUE MPDS (%) | MEAN VALUE OF VARIATION RANGE (mm) |
|---|---|---|---|
| DRAINAGE 13 mm | 1. 60 | 6. 29 | 1. 75 |
| DRAINAGE 5 mm | 0. 80 | 3. 84 | 0. 77 |
| DENSE GRADED | 0. 41 | 7. 84 | 0. 47 |

| | MINIMUM VALUE | | MAXIMUM VALUE |
|---|---|---|---|
| DRAINAGE 13 mm | 1.638 ≦ | μ | ≦ 1.684 |
| DRAINAGE 5 mm | 0.847 ≦ | μ | ≦ 0.865 |
| DENSE GRADED | 0.388 ≦ | μ | ≦ 0.400 |

| | CONFIDENCE INTERVAL | |
|---|---|---|
| | 95% | 99% |
| DRAINAGE 13 mm | 0.070 | 0.092 |
| DRAINAGE 5 mm | 0.027 | 0.035 |
| DENSE GRADED | 0.018 | 0.023 |

ROAD SURFACE STATE ESTIMATING SYSTEM AND ROAD SURFACE STATE MEASURING APPARATUS

BACKGROUND OF THE INVENTION

1. Field of the Invention

The present invention relates to a road surface state estimating system and road surface state measuring apparatus for estimating the state of texture of a paved road surface.

2. Description of the Related Art

Noise caused at the interface between a tire and a road surface when a vehicle is running (referred to as, for example, traffic noise) is a conventional problem as noise common nuisance. Traffic noise caused by a vehicle is closely related to the state of a paved road surface. In recent years, low noise pavement having a function of lowering the traffic noise is becoming prevailing, and attracting attention. The noise lowering effect of such low noise pavement is thought to be attributable to sound absorbing action of voids formed on the road surface and sound lowering action of the road surface based on the state of texture thereof. The texture of the road surface is also reflected on the friction between a tire of the running vehicle and the road surface, i.e., skid resistance. In this way, the texture of a road surface is thought to be an important factor for grasping the characteristics of a road surface.

JP 2002-303514 A (paragraphs [0010], [0012] to [0014], and [0030]; FIGS. 1 and 2) (hereinafter referred to simply as "JP 2002-303514 A") discloses a conventional method of measuring the state of the texture of a road surface. The measuring method described in JP 2002-303514 A includes the steps of: horizontally moving a laser displacement meter keeping a predetermined distance from the road surface to generate an original data column having data of measured distances to the road surface at respective positions at predetermined sampling intervals, the data being arranged in the order of measurement; generating a displaced data column having displaced data prepared by displacing the original data column in the direction of the column by a displacement pitch, the displacement pitch being an integral multiple of a sampling interval; determining a regression line of point data group with the original data being an independent variable and the displaced data being a dependent variable and calculating the proportion of variance of the regression line and the point data group to determine a correlated data group of the displacement pitch and the proportion of variance; regressively analyzing the correlated data group to determine an exponential regression curve of the proportion of variance with regard to the displacement pitch; determining the proportion of variance of the exponential regression curve and the correlated data group; and selecting, according to the proportion of variance, a proportion of variance for microscopic definition and a proportion of variance for macroscopic definition and defining the values of the displacement pitches in the exponential regression curve corresponding to the respective proportions of variance as microscopic roughness and macroscopic roughness of the road surface.

In the first step of the measuring method, a measuring apparatus as illustrated in FIG. 2 of the literature is used to measure the state of a road surface. The measuring apparatus has a laser displacement meter of a known structure and moving means for horizontally moving the laser displacement meter keeping a predetermined distance from the road surface. The moving means includes a pair of guide axes horizontally provided between supporting pieces of a body frame, a screw shaft (ball screw) rotatably supported by the supporting pieces and in parallel with the guide axes, and a stepping motor for rotating the screw shaft. The laser displacement meter is horizontally moved by the screw shaft which is driven by the stepping motor to rotate. It is to be noted that the sampling rate of data by a conventional laser displacement meter was on the order of ten samples per second (see, for example, Tsutomu IHARA et al., "A STUDY OF THE RELATIONSHIP BETWEEN SURFACE TEXTURE AND TIRE/ROAD NOISE OF POROUS ASPHALT PAVEMENT", Journal of Pavement Engineering, Vol. 7, pp. 1-1 to 1-6, 2002, The Japan Society of Civil Engineers (JSCE) (hereinafter referred to simply as "Non-Patent Literature 1")).

In such measurement of the state of a road surface, first, in a measurement section (referred to as a "measuring line") of several dozen centimeters to about one meter, the distance to the road surface is measured with the sampling intervals being, for example, about 0.1 millimeters (see, for example, JP 2002-303514 A). More specifically, microscopic asperities (displacement in the height direction) on the road surface are measured. Then, the result of the measurement along the measuring line (suppose it is 1 m in length) is divided into, for example, ten subsections each 10 cm in length, and texture scores in the respective subsections are determined. Here, the length of each subsection is a standard for calculating the scores, and sometimes referred to as a "standard length".

Further, in conventional measurement of the state of a road surface, as disclosed in JP 2002-303514 A, a laser displacement meter is moved in one direction (in the axial direction of the above-described screw shaft) to obtain data along the single measuring line. However, taking into account the fact that the actual texture of a road surface (paved surface) is not uniform depending on the selected aggregate, the way the roller compaction is made during the execution of work, and the like, measurement along only a single measuring line cannot obtain a satisfactory number of data and the measurement range is limited. Thus, it does not follow that the result of the measurement accurately reflects the whole road surface, and therefore, reliability problems may arise in the texture estimation based on the result of measurement according to the conventional method.

JP 2000-131043 A (paragraph [0017]) (hereinafter referred to simply as "JP 2000-131043 A") discloses another conventional method of measuring the state of the texture of a road surface. Disclosed in JP 2000-131043 A is a road surface roughness measuring apparatus used in combination with a rotating kinetic friction coefficient measuring device, the road surface roughness measuring apparatus including a frame having a plurality of legs for positioning the apparatus on a road surface, the frame having a vertically extending rotating shaft provided thereon, the rotating shaft having a rotary encoder attached to an upper end thereof and a rotating plate attached to a lower end thereof, the road surface roughness measuring apparatus further including a motor with a speed reducer for driving the rotating shaft through gears, and a laser displacement meter attached to the rotating plate, the laser displacement meter being positioned to carry out measurement along a measurement circle where the rotating kinetic friction coefficient measuring device measured a coefficient of kinetic friction by rotation of the rotating plate, the measurement circle being divided into a plurality of sections, and the road surface roughness for each of the divided sections being calculated based on signals from the laser displacement meter and the rotary encoder.

The measuring apparatus of JP 2000-131043 A estimates the texture along a measurement circle where a coefficient of kinetic friction of the road surface is measured. Since, similar to JP 2002-303514 A, the texture is estimated based on data on a single measuring line, it is difficult to expect that the result of estimation is sufficiently reliable.

It is to be noted that conventional estimation of the texture of road surface as disclosed in JP 2000-131043 A and JP 2002-303514 A is thought to have a certain extent of reliability when used in estimation of a relatively even road surface with only small asperities such as dense graded pavement. However, the reliability of such conventional estimation is particularly insufficient when applied to estimation of the texture of a road surface with large asperities such as drainage pavement which is becoming popular these days.

Further, in conventional texture estimation, MPD (Mean Profile Depth) described in, for example, JP2000-131043A (paragraph [0017]), accumulated extension ratio of asperities (see, for example, Non-Patent Literature 1), contact portion ratio (see, for example, Yoshimasa HASHIMOTO et al., "PREDICT OF TIRE/ROAD NOISE FROM ROAD SURFACE PROPERTIES", Journal of Pavement Engineering, Vol. 7, pp. 2-1 to 2-9, 2002, The Japan Society of Civil Engineers (JSCE) (hereinafter referred to simply as "Non-Patent Literature 2")), or the like is independently used as the score (hereinafter referred to as the "texture score"). Therefore, comprehensive estimation reflecting texture scores of a plurality of kinds cannot be conducted, and by extension, it is difficult to do reliable estimation.

SUMMARY OF THE INVENTION

The present invention has been made in view of the above. An object of the present invention is to provide a road surface state measuring system and a road surface state measuring apparatus which can, in order to estimate the texture of a paved road surface, carry out measurement along a plurality of measuring lines on the road surface.

Another object of the present invention is to provide a road surface state measuring system and a road surface state measuring apparatus which can improve the reliability of texture estimation of a paved road surface.

In order to achieve the above objects, according to a first aspect of the present invention, there is provided a road surface state measuring system including: measuring means for measuring a distance to road surface; scanning means for moving the measuring means to scan measurement positions of the distance to the road surface; and calculating means for calculating texture scores used for estimating texture of the road surface based on a measurement data column of the distance to the road surface obtained by the moved measuring means, wherein the scanning means moves the measuring means two-dimensionally.

Further, according to a second aspect of the present invention, there is provided a road surface state measuring system according to the first aspect, wherein said scanning means includes: main scanning means for moving the measuring means in a predetermined main scanning direction to scan the measurement positions; and sub scanning means for moving the measuring means in a sub scanning direction orthogonal to the main scanning direction.

Further, according to a third aspect of the present invention, there is provided a road surface state measuring system according to the second aspect, wherein the measuring means changes its position in the sub scanning direction by the sub scanning means, and by continuously measuring the distance at predetermined measurement intervals when the measuring means is moved in the main scanning direction by the main scanning means at the changed position and obtaining the measurement data column corresponding to the position, obtains a plurality of the measurement data columns corresponding to a plurality of positions in the sub scanning direction.

Further, according to a fourth aspect of the present invention, there is provided a road surface state measuring system according to the third aspect, wherein the calculating means divides the plurality of measurement data columns obtained by the measuring means into a plurality of subdata columns, respectively, calculates the texture scores with regard to the respective subdata columns, and calculates a mean value of the texture scores with regard to the respective subdata columns.

Further, according to a fifth aspect of the present invention, there is provided a road surface state measuring system according to the third aspect, wherein the calculating means calculates the texture scores with regard to the plurality of measurement data columns obtained by the measuring means, respectively, and calculates a mean value of the texture scores with regard to the respective calculated plurality of measurement data columns.

Further, according to sixth to ninth aspects of the present invention, there is provided a road surface state measuring system according to any one of the second to fifth aspects, wherein the main scanning means includes: principal driving means for driving the measuring means; and principal guiding means for guiding the driven measuring means in the main scanning direction.

Further, according to tenth to thirteenth aspects of the present invention, there is provided a road surface state measuring system according to any one of the second to fifth aspects, wherein the sub scanning means includes: auxiliary driving means for driving the measuring means; and auxiliary guiding means for guiding the driven measuring means in the sub scanning direction.

Further, according to a fourteenth aspect of the present invention, there is provided a road surface state measuring system according to the second aspect, wherein the main scanning means moves the measuring means in a circumferential direction, substantially in parallel with the road surface, and the sub scanning means moves the measuring means in a radial direction orthogonal to the circumferential direction.

Further, according to a fifteenth aspect of the present invention, there is provided a road surface state measuring system according to the fourteenth aspect, wherein the measuring means changes its position in the radial direction by the sub scanning means, and by measuring the distance at predetermined measurement intervals when the measuring means is moved in the circumferential direction by the main scanning means at the changed position and obtaining the measurement data column corresponding to the position, obtains a plurality of the measurement data columns along concentric (concentric-circle-like) measuring lines.

Further, according to a sixteenth aspect of the present invention, there is provided a road surface state measuring system according to the fourteenth aspect, wherein the measuring means obtains the measurement data column along a spiral measuring line by measuring the distance at predetermined measurement intervals when the measuring means is moved in the circumferential direction by the main scanning means while moved in the radial direction by the sub scanning means at a predetermined speed and obtaining the measurement data column.

Further, according to a seventeenth aspect of the present invention, there is provided a road surface state measuring system according to the first aspect, further including: storing means for storing an acceptable range of the texture scores set in advance; deciding means for deciding whether the texture scores calculated by the calculating means are within the acceptable range or not; and notifying means for making a notification that the deciding means has decided that the texture scores are not within the acceptable range.

Further, according to an eighteenth aspect of the present invention, there is provided a road surface state measuring system according to the seventeenth aspect, wherein: the storing means stores acceptable ranges for the texture scores of a plurality of kinds; the calculating means calculates the texture scores of the plurality of kinds based on the measurement data columns; and the deciding means decides whether the respective calculated texture scores of the plurality of kinds are within the acceptable ranges stored in the storing means.

Further, according to a nineteenth aspect of the present invention, there is provided a road surface state measuring system according to the eighteenth aspect, wherein: the texture scores of the plurality of kinds include at least one of mean profile depth, accumulated extension ratio of asperities, and contact portion ratio.

Further, according to a twentieth aspect of the present invention, there is provided a road surface state measuring apparatus including: measuring means for measuring a distance to road surface; and scanning means for moving the measuring means to scan measurement positions of the distance to the road surface, the road surface state measuring apparatus obtaining a measurement data column of the distance to the road surface used for estimating texture of the road surface by the moved measuring means, wherein the scanning means moves the measuring means two-dimensionally.

The road surface state measuring system and a road surface state measuring apparatus according to the present invention each include the measuring means for measuring the distance to the road surface and the scanning means for two-dimensionally moving the measuring means with respect to the road surface, whereby the measurement can be carried out not only along a single measuring line as in conventional measuring but along a plurality of measuring lines.

Further, even when measuring along only a single measuring line is carried out, by moving the measuring means two-dimensionally, it is possible to make the measurement range by far wider than that of conventional measurement to obtain a large amount of measurement data, which can improve the reliability of texture estimation of a paved road surface.

In particular, the road surface state measuring system according to the fourth or fifth aspect of the present invention is configured to determine the mean value of the plurality of texture scores based on the plurality of measurement data columns corresponding to the plurality of measuring lines, whereby texture estimation can be conducted more accurately reflecting the whole road surface than a conventional system, which can improve the reliability of the estimation.

Further, the road surface state measuring system according to any one of the eleventh to thirteenth aspects of the present invention is configured to decide whether the texture scores are within the acceptable range or not, and if it is decided that they are outside the acceptable range, to make a notification to that effect, whereby it can be easily known that an abnormality has occurred. Then, the cause of the abnormality can be found in situ, feedback can be made in real time, and the execution of work can be corrected. Accordingly, the present invention is effectively utilized in situ.

In particular, the road surface state measuring system according to the twelfth aspect of the present invention can make a decision with regard to the texture scores of the plurality of kinds, whereby comprehensive texture estimation can be effectively conducted in situ.

BEST MODE FOR CARRYING OUT THE INVENTION

According to the present invention, the texture of a road surface is estimated by carrying out measurement along a plurality of measuring lines as opposed to conventional measurement along only a single measuring line. Further, in the measurement according to the present invention compared with the conventional measurement the measurement is characterized in that a plurality of position within the measuring range is measured. A preferred embodiment of the present invention suitable for materializing such a novel measuring method is now described with reference to the attached drawings.

[Overall Structure of the System and Structures of Units Thereof]

Figure 1:
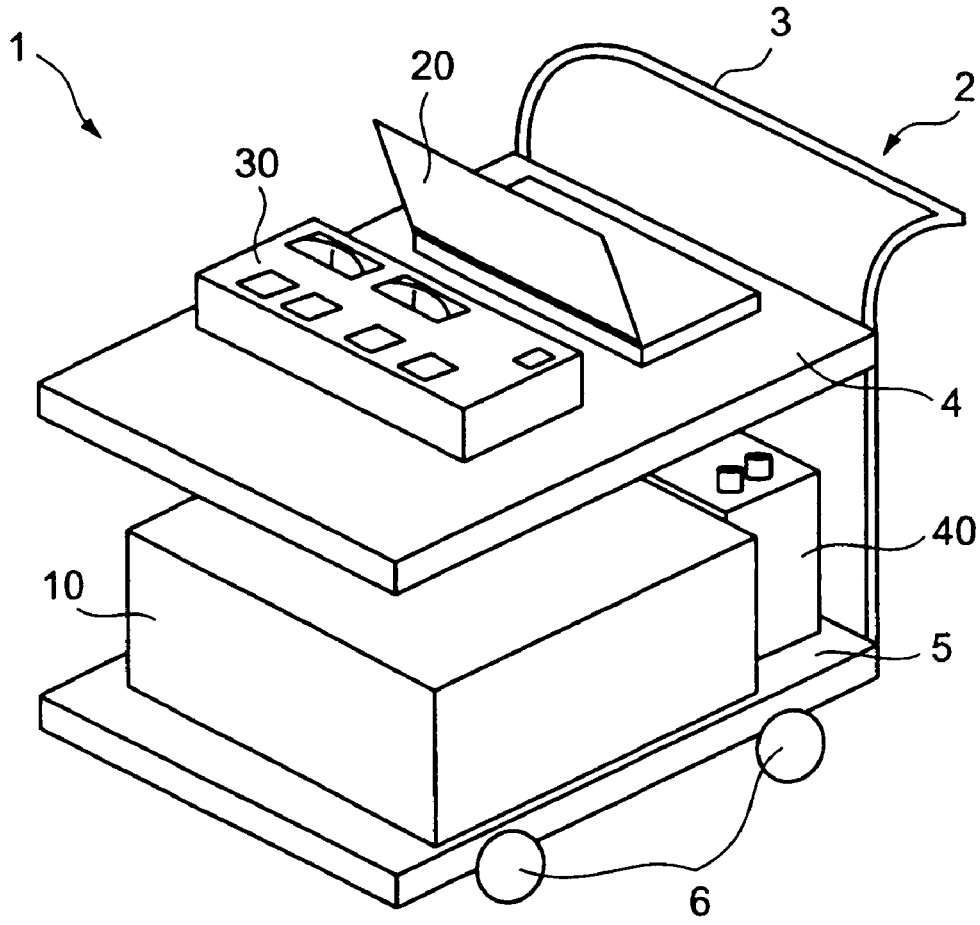
FIG. 1 is a schematic perspective view illustrating an exemplary outside structure of a road surface state measuring system according to an embodiment of the present invention.

FIG. 1 illustrates a schematic outside structure of a road surface state measuring system 1 according to an embodiment of the present invention. The road surface state measuring system 1 includes a plurality of devices mounted on a carriage 2 for moving the system 1. The carriage 2 has: a frame 3 formed of, for example, metal, and provided with a handle portion; upper and lower device-mounting shelves 4 and 5 fixed to the frame 3; and wheels 6 such as casters provided on the bottom of the lower device-mounting shelf 5. Stoppers for preventing rotation of the wheels 6 may be provided to prevent free movement of the system 1 during measurement or during storage.

The lower device-mounting shelf 5 has a measurement body portion 10 for housing various kinds of devices such as a laser displacement meter described below and a battery 40 for supplying electric power both mounted thereon. A power supply circuit (described below) for controlling power supply to the measurement body portion 10 and the like is connected to the battery 40. Further, the upper device-mounting shelf 4 has a (notebook) computer 20 for controlling operation of units of the system, for analyzing the result of measurement by the measurement body portion 10, and the like, and a control box 30 for operating units of the system both mounted thereon.

The laser displacement meter is a device for measuring the distance to an object to be measured (road surface). Scanning means which will be described below scans measurement positions of the laser displacement meter along measuring lines, thereby obtaining displacement of the distance to the road surface along the measuring lines, that is, displacement of the asperities on the road surface along the measuring lines. The state of the texture of the road surface is estimated based on the state of the displacement of the asperities on the road surface.

The laser displacement meter used in this embodiment has a known structure. For example, the laser displacement meter is configured to include a laser light source such as a semiconductor laser, a condenser lens for condensing laser light from the laser light source, an imaging lens for imaging using laser light reflected from the road surface, a photoreceptor for detecting imaging positions of the laser light such as a position sensitive detector (PSD), an arithmetic circuit for calculating the distance between the laser displacement meter and the road surface based on the result of the detection of the imaging positions using the laser light, and the like. The calculation processing of the distance may be performed by the computer 20. It is to be noted that the measurement positions of the laser displacement meter described above correspond to positions on the road surface where the laser light is reflected.

(Measurement Body Portion)

Figure 2:
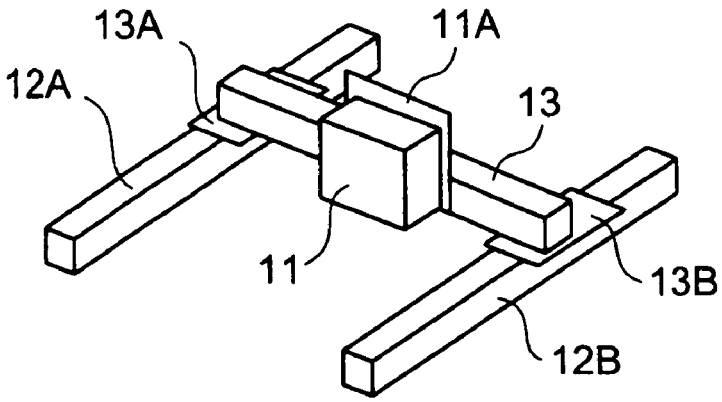
FIG. 2 is a schematic perspective view illustrating an exemplary structure of a laser displacement meter and rails in the road surface state measuring system according to the embodiment of the present invention.

FIG. 2 illustrates a schematic structure of a laser displacement meter 11 housed in the measurement body portion 10, and of rails 12A, 12B, and 13 for guiding the movement of the laser displacement meter 11. The rails 12A and 12B are provided in parallel with each other while the rail 13 is provided so as to connect the rails 12A and 12B via mounting members 13A and 13B. The rails 12A and 12B and the rail 13 are orthogonal to each other.

Further, at least when the measurement is carried out by the laser displacement meter 11, rails 12A, 12B, and 13 are positioned so as to be in parallel with the road surface. This allows the laser displacement meter 11 to be translated with respect to the road surface. It is preferable that, in this way, the laser displacement meter 11 is translated with respect to the road surface so as not to macroscopically change the distance between the laser displacement meter 11 and the road surface, although the present invention is not limited thereto. For example, the laser displacement meter 11 may be configured to be linearly moved, e.g., the laser displacement meter 11 may be moved in a slanted direction with respect to the road surface. Further, if the laser displacement meter 11 is configured such that its locus of movement can be referred to, it is no longer necessary that the movement of the laser displacement meter 11 is linear. More specifically, the result of the measurement of the distance to the road surface can be corrected based on the locus of movement of the laser displacement meter 11.

The laser displacement meter 11 constitutes "measuring means" of the present invention, and is attached to a side of the rail 13 through amounting member 11A. The mounting member 11A is provided so as to be movable in a longitudinal direction of the rail 13 by being driven by a stepping motor. The laser displacement meter 11 is moved integrally with the mounting member 11A. The longitudinal direction of the rail 13 is herein referred to as "sub scanning direction". The laser displacement meter 11 is controlled so as not to carry out measurement when moved in the sub scanning direction (described in detail below).

The mounting members 13A and 13B are provided so as to be movable in a longitudinal direction of the rails 12A and 12B on the rails 12A and 12B by being driven by a stepping motor. The laser displacement meter 11 is moved in the longitudinal direction of the rails 12A and 12B integrally with the rail 13 and the mounting members 13A and 13B.

The longitudinal direction of the rails 12A and 12B is herein referred to as "main scanning direction". The measurement body portion 10 is positioned such that the main scanning direction is the direction of the measuring lines (in other words, the direction of the measuring lines in this embodiment is the main scanning direction). The laser displacement meter 11 is controlled so as to carry out measurement while it is being moved in the main scanning direction (described in detail below). This allows the measurement positions on the road surface by the laser displacement meter 11 to be scanned in the main scanning direction.

In this way, the road surface state measuring system 1 of this embodiment is characterized by a structure where the laser displacement meter 11 is independently moved in the main scanning direction and in the sub scanning direction orthogonal to the main scanning direction. It is to be noted that, generally, the rails 12A and 12B and the rail 13 may be positioned diagonally with respect to each other such that the main scanning direction and the sub scanning direction are diagonal with respect to each other. In other words, according to the present invention, it is enough that the laser displacement meter 11 is two-dimensionally movable.

Figure 3A:
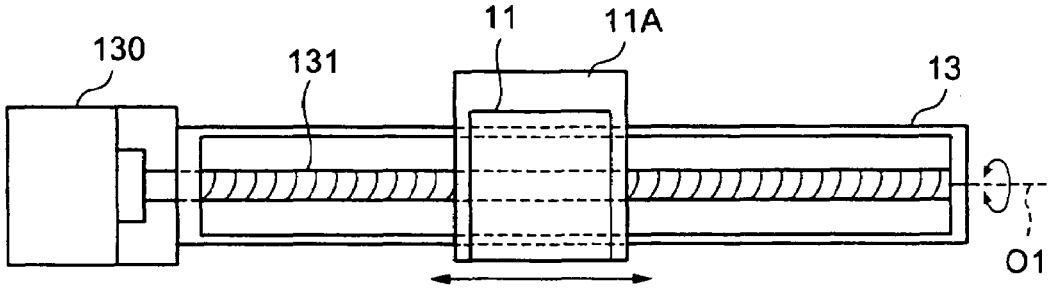
FIG. 3A is a schematic front view illustrating an exemplary structure for moving the laser displacement meter in the road surface state measuring system according to the embodiment of the present invention.
Figure 3B:
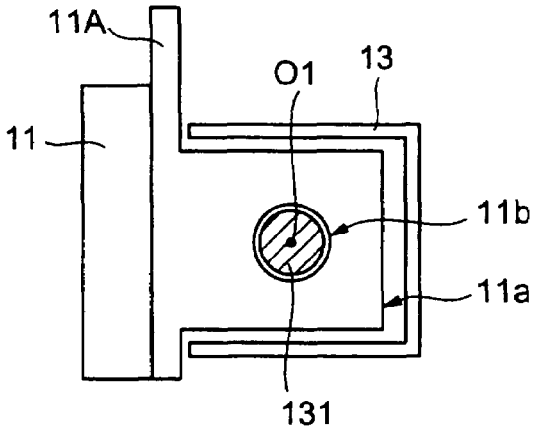
FIG. 3B is a schematic sectional view illustrating the exemplary structure for moving the laser displacement meter in the road surface state measuring system according to the embodiment of the present invention.

FIGS. 3A and 3B illustrate a schematic structure for moving the laser displacement meter 11 in the longitudinal direction of the rail 13 (sub scanning direction). FIG. 3A is a front view of the laser displacement meter 11, the rail 13, and the like, while FIG. 3B is a sectional view taken along the width direction of the rail 13.

The side of the rail 13 on the side of the laser displacement meter 11 is open along its longitudinal direction. A ball screw 131 is provided in the rail 13 along its longitudinal direction. A stepping motor 130 is provided on one end of the rail 13, and one end of the ball screw 131 is connected to a rotating shaft of the stepping motor 130. The other end of the ball screw 131 is rotatably connected to the other end of the rail 13. The ball screw 131 is driven by the stepping motor 130 and rotates about an axis O1.

A protrusion 11*a* protruding from the above-described opening on the side of the rail 13 toward the inside of the rail 13 is formed on the mounting member 11A. A female thread 11*b* is provided approximately in the center of the protrusion 11*a* along the longitudinal direction of the rail 13. The ball screw 131 is engaged in the female thread 11*b*.

When the ball screw 131 is driven by the stepping motor 130 and rotates about the axis O1, the engagement of the ball screw 131 and the female thread 11*b* moves the mounting member 11A in the longitudinal direction of the rail 13. The direction of movement of the mounting member 11A is controlled by the direction of rotation of the stepping motor 130. In this way, the laser displacement meter 11 is movable in the sub scanning direction.

The stepping motor 130, the rail 13, the ball screw 131, and the mounting member 11A constitute "sub scanning-means" of the present invention. The stepping motor 130 constitutes "auxiliary driving means" of the present invention, for driving the laser displacement meter 11. The rail 13, the ball screw 131, and the mounting member 11A constitute "auxiliary guiding means" of the present invention, for guiding in the sub scanning direction the laser displacement meter 11 and the like driven by the stepping motor 130.

Figure 4A:
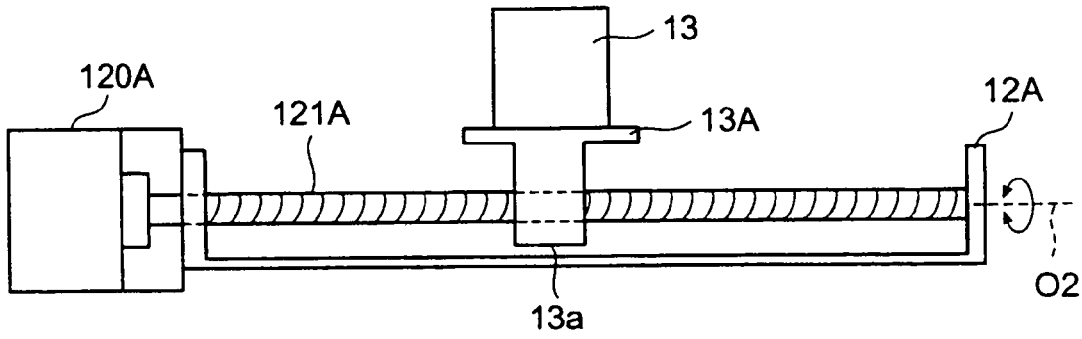
FIG. 4A is a schematic side view illustrating an exemplary structure for moving the laser displacement meter in the road surface state measuring system according to the embodiment of the present invention.
Figure 4B:
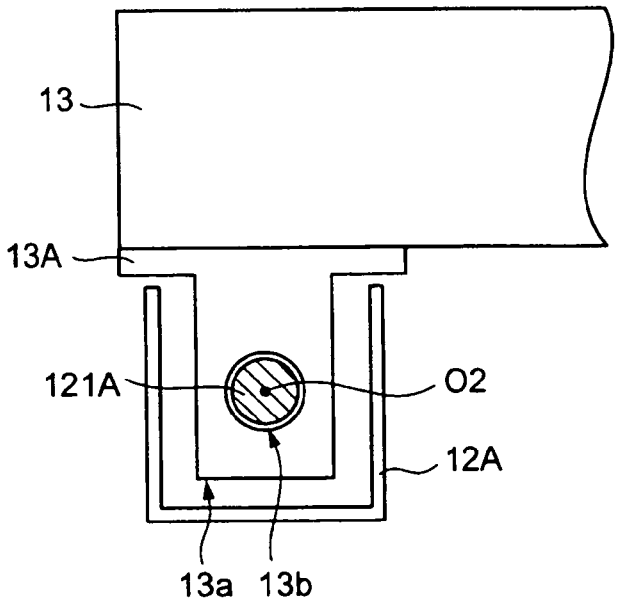
FIG. 4B is a schematic sectional view illustrating the exemplary structure for moving the laser displacement meter in the road surface state measuring system according to the embodiment of the present invention.

FIGS. 4A and 4B illustrate a schematic structure for moving the rail 13 (i.e., the laser displacement meter 11) in the longitudinal direction of the rail 12A (main scanning direction). FIG. 4A is a side view of the rail 12A, the rail 13, and the like, while FIG. 4B is a sectional view taken along the width direction of the rail 12A. If necessary, a mechanism similar to the one illustrated in FIGS. 4A and 4B may be provided on the side of the rail 12B.

A top face of the rail 12A is open along its longitudinal direction. A ball screw 121A is provided in the rail 12A along its longitudinal direction. A stepping motor 120A is provided on one end of the rail 12A, and one end of the ball screw 121A is connected to a rotating shaft of the stepping motor 120A. The other end of the ball screw 121A is rotatably connected to the other end of the rail 12A. The ball screw 121A is driven by the stepping motor 120A and rotates about an axis O2.

A protrusion 13*a* protruding from the above-described opening on the top face of the rail 12A toward the inside of the rail 12A is formed on the mounting member 13A. A female thread 13*b* is provided approximately in the center of the protrusion 13*a* along the longitudinal direction of the rail 12A. The ball screw 121A is engaged in the female thread 13*b*.

When the ball screw 121A is driven by the stepping motor 120A and rotates about the axis O2, the engagement of the ball screw 121A and the female thread 13*b* moves the mounting member 13A in the longitudinal direction of the rail 12A. The direction of movement of the mounting member 13A is controlled by the direction of rotation of the stepping motor 120A. In this way, the laser displacement meter 11 is movable in the main scanning direction.

The stepping motor 120A, the rails 12A and 12B, the ball screw 121A, and the mounting members 13A and 13B constitute "main scanning means" of the present invention. The stepping motor 120A constitutes "principal driving means" of the present invention, for driving the laser displacement meter 11. The rails 12A and 12B, the ball screw 121A, and the mounting members 13A and 13B constitute "principal guiding means" of the present invention, for guiding in the main scanning direction of the laser displacement meter 11 and the like driven by the stepping motor 120A. When a stepping motor and a ball screw are also provided on the side of the rail 12B, they are also included in the main scanning means, and the stepping motor is included in the principal driving means while the ball screw is included in the principal guiding means.

The stepping motor 120A, the rails 12A and 12B, the ball screw 121A, and the mounting members 13A and 13B which constitute the main scanning means and the stepping motor 130, the rail 13, the ball screw 131, and the mounting member 11A which constitute the sub scanning means together constitute the "scanning means" of the present invention.

It is to be noted that the structure illustrated in FIG. 2 to FIG. 4 constitutes an exemplary "road surface state measuring apparatus" of the present invention.

(Elevator/Mechanism)

An elevator mechanism for vertically moving the laser displacement meter 11 and a moving mechanism for moving the laser displacement meter 11 (the rails 12A, 12B, and 13, the stepping motors 120A and 130, and the like) is provided in the measurement body portion 10. The lower device-mounting shelf 5 has an opening (not shown) formed therein the area of which is smaller than that of a bottom surface of the measurement body portion 10. The elevator mechanism vertically moves the laser displacement meter 11 and the above-described moving mechanism through the opening. The laser displacement meter 11 and the like descend to a predetermined position near the road surface when the state of the texture of the road surface is estimated, and are housed in the measurement body portion 10 when the road surface state measuring system 1 is moved. The vertical movement of the laser displacement meter 11 and the like is carried out according to operation by an operator (described in detail below). Such an elevator mechanism can prevent the laser displacement meter 11 and the like from hitting or rubbing on bumps on the road surface when the system 1 is moved. Further, with a structure where the bottom surface of the moving mechanism or the like comes in contact with the road surface when the laser displacement meter 11 and the like descend, the stability of the laser displacement meter 11 during measurement is enhanced. In other words, even without the above-described stoppers for preventing rotation of the wheels 6, the laser displacement meter 11 can be prevented from freely moving during measurement.

Figure 5:
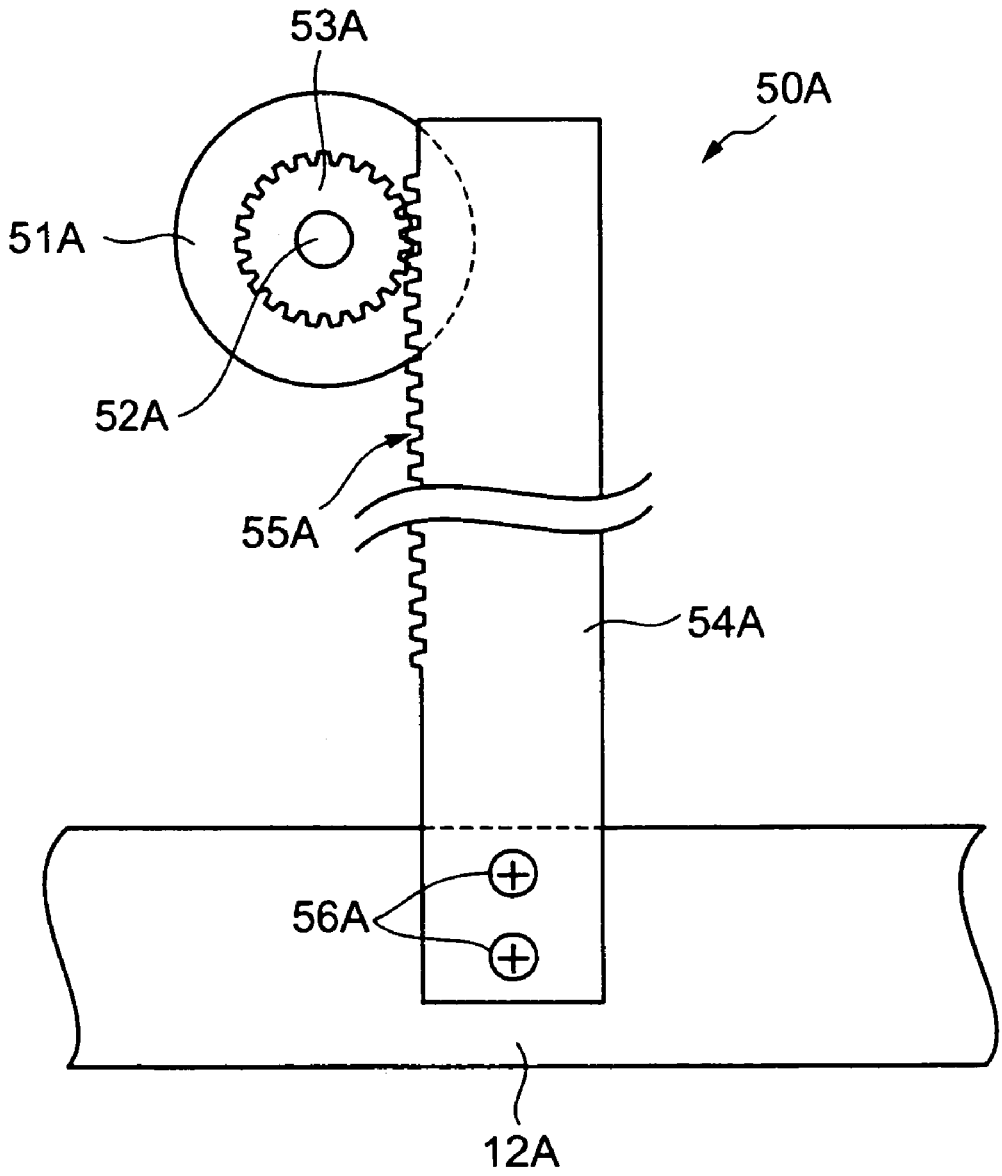
FIG. 5 is a schematic side view illustrating an exemplary structure for vertically moving the laser displacement meter and the like in the road surface state measuring system according to the embodiment of the present invention.

FIG. 5 is a schematic illustration of an exemplary elevator mechanism. An elevator mechanism 50A illustrated in the figure directly moves the rail 12A vertically, and a similar elevator mechanism 50B is provided on the side of the rail 12B. The operation of the elevator mechanism 50A and the operation of the elevator mechanism 50B are simultaneously controlled. The laser displacement meter 11, the rail 13, the stepping motors 120A and 130, and the like are driven by the pair of elevator mechanisms 50A and 50B and vertically moved integrally with the rails 12A and 12B.

The elevator mechanism 50A illustrated in FIG. 5 includes a motor 51A fixedly provided on an inner wall of the housing of the measurement body portion 10 or the like, a gear 53A coaxially connected to a rotating shaft 52A of the motor 51A to rotate integrally with the rotating shaft 52A, and an arm 54A an end of which is fixed to the rail 12A by screws 56A with its longitudinal direction being the vertical direction. An engaging portion 55A for engaging with the gear 53A is formed on one side of the arm 54A.

When the motor 51A rotates the rotating shaft 52A, the rotational movement of the gear 53A which rotates integrally with the rotating shaft 52A is converted to vertical movement of the arm 54A by the engagement of the gear 53A and the engaging portion 55A, which vertically moves the rail 12A.

The direction of the movement of the rail 12A is switched by switching the direction of rotation of the motor 51A. In FIG. 5, when the motor 51A rotates the rotating shaft 52A clockwise, the rail 12A is moved downward, while when the motor 51A rotates the rotating shaft 52A counterclockwise, the rail 12A is moved upward.

It is to be noted that the elevator mechanism of the present invention is not limited to the structure illustrated in FIG. 5, and an arbitrary structure can be applied so far as the laser displacement meter 11 and the like can ascend/descend. For example, an elevator mechanism may be applied where the rails 12A and 12B are rotatably connected to one end of a pair of arms, respectively, and stepping motors are provided on the respective other ends, such that the arms are horizontally positioned when the laser displacement meter 11 and the like are housed in the measurement body portion 10 and the arms are rotated downward in a vertical plane by the stepping motors when the laser displacement meter 11 and the like descend to the vicinity of the road surface.

Further, a mechanism where an operator manually makes the laser displacement meter 11 and the like ascend/descend may also be applied.

Further, the elevator mechanism is not required to be housed in the measurement body portion 10. For example, when a structure where the measurement body portion 10 itself is vertically moved is adopted, the elevator mechanism can be provided outside the measurement body portion 10. In this case, the above-described opening of the lower device-mounting shelf 5 is formed such that its area is larger than that of the bottom surface of the measurement body portion 10.

(Control Box)

Figure 6:
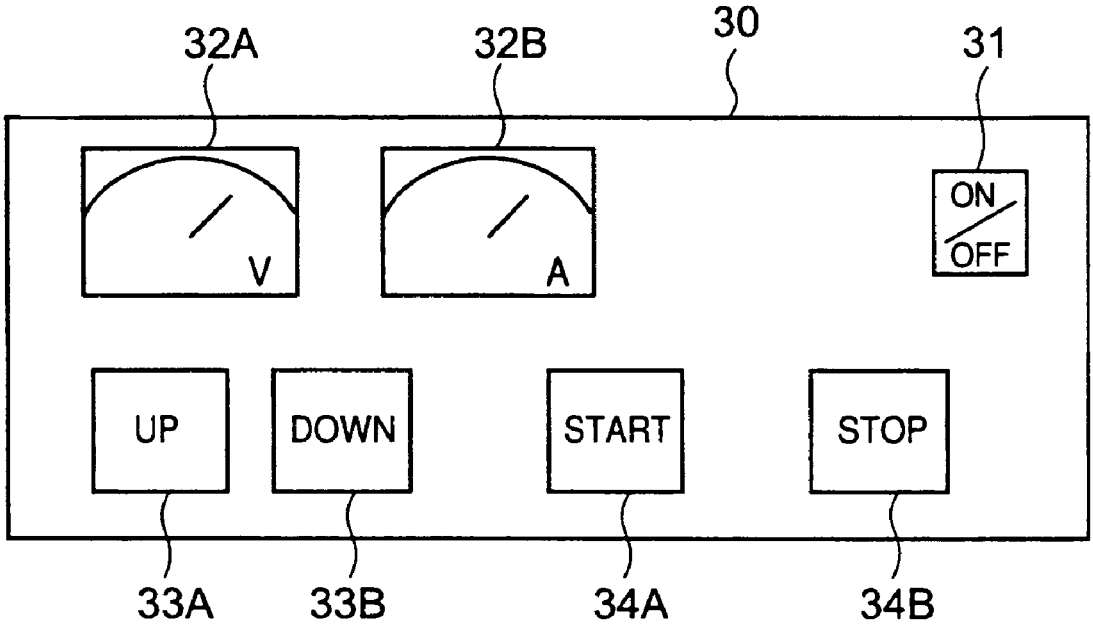
FIG. 6 is a schematic plan view illustrating an exemplary structure of a control box in the road surface state measuring system according to the embodiment of the present invention.

FIG. 6 is a plan view illustrating a schematic structure of the control box 30. A power button 31 for switching on/off the system 1, a voltage indicator 32A for indicating power source voltage supplied by the battery 40, a current indicator 32B for indicating power source current, an up button 33A operated to make the laser displacement meter 11 and the like ascend using the elevator mechanisms 50A and 50B, a down button 33B operated to make the laser displacement meter 11 and the like descend using the elevator mechanisms 50A and 50B, a measurement start button 34A operated to start measurement using the laser displacement meter 11, and a measurement stop button 34B operated to stop the measurement are provided on an operating panel of the control box 30.

It is to be noted that, when the above-described operation is effected using a keyboard, a mouse, or the like of the computer 20, it is not necessary to provide the control box 30. Further, when necessary, means (e.g., buttons) for effecting operation other than the above-described operation may be provided. Still further, when, for example, the computer 20 has a dedicated battery mounted thereon, the computer 20 may be switched on/off not with the power button 31 but with a power button of the computer 20 itself or the like.

[Structure of Control System]

Next, a structure of a control system of the road surface state measuring system 1 of this embodiment is described with reference to a block diagram of FIG. 7. As described above, the system 1 is controlled by the computer 20.

It is to be noted that, in this embodiment, in order to move with stability the rail 13 in the longitudinal direction of the rails 12A and 12B (main scanning direction), the structure illustrated in FIG. 4 is also provided on the side of the rail 12B, and a stepping motor on the side of the rail 12B is designated by reference symbol 120B.

Figure 7:
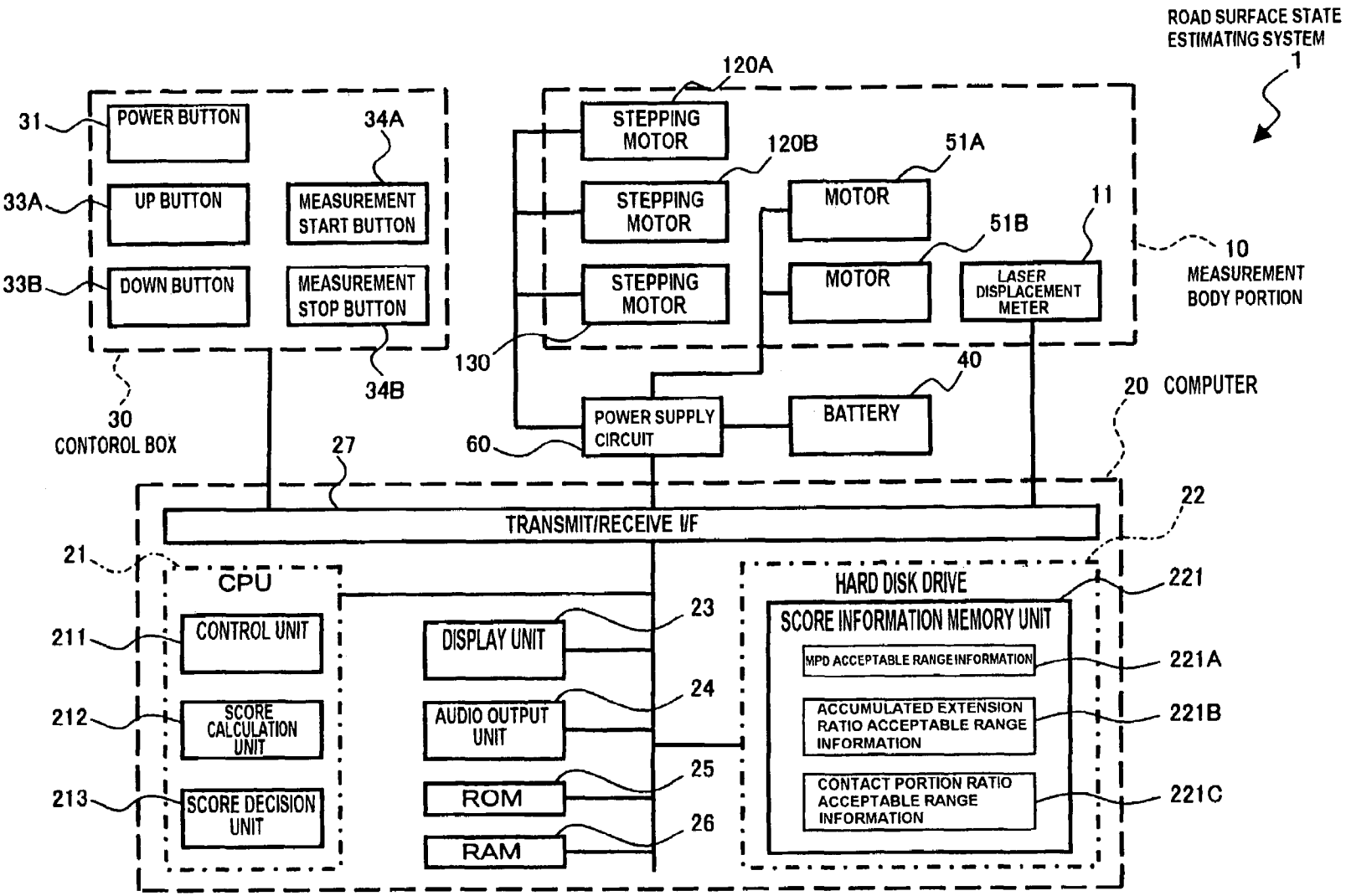
FIG. 7 is a block diagram illustrating an exemplary structure of a control system in the road surface state measuring system according to the embodiment of the present invention.

As illustrated in FIG. 7, the laser displacement meter 11, the stepping motors 120A, 120B, and 130, the motors 51A and 51B, and the control box 30 of the measurement body portion 10 are connected to the computer 20. The stepping motors 120A, 120B, and 130 and the motors 51A and 51B are connected to the computer 20 through a power supply circuit 60.

(Computer)

The computer 20 includes a CPU 21, a hard disk drive (HDD) 22, a display unit 23, an audio output unit 24, a ROM 25, a RAM 26, and a transmitting/receiving interface (I/F) 27.

It is to be noted that, instead of HDD 22, a drive (for reading from and writing to an arbitrary storage medium such as a CD-ROM, a CD-R (W), a DVD-ROM, a DVD-RAM, an MO, and a floppy (registered trademark) disk) accessible by the computer 20 may be used. In this case, necessary information is stored in advance in the storage medium.

The CPU 21 controls the units of the system 1 and analyzes the result of measurement by the laser displacement meter 11 by decompressing on the RAM 26 and executing a computer program (not shown) stored in the HDD 22 or the ROM 25.

Such computer programs include: system control programs for causing the CPU 21 to control, for example, the measurement using the laser displacement meter 11, the movement of the laser displacement meter 11 in the main scanning direction and in the sub scanning direction, the ascent/descent operation of the laser displacement meter 11 and the like using the elevator mechanism 50A; score calculation programs for causing the CPU 21 to calculate the texture scores of the road surface; and decision programs for causing the CPU 21 to decide whether the calculated texture scores are appropriate or not. The CPU 21 operates as a control unit 211, a score calculation unit 212, a score decision unit 213, and the like in this order by executing the above programs, respectively.

The control unit 211 controls the units of the system according to processing flows of the system control programs. When a button on the control box 30 is operated, an operation signal is sent to the computer 20 and the control unit 211 controls the system based on the operation signal.

The score calculation unit 212 corresponds to "calculating means" of the present invention, and calculates the texture scores of the road surface based on the measurement data obtained by the laser displacement meter 11. In this embodiment, as a texture score, at least one of a mean profile depth (MPD), an accumulated extension ratio of asperities (sometimes referred to simply as an accumulated extension ratio), and a contact portion ratio is used. Those texture scores are briefly described below.

The score decision unit 213 corresponds to "deciding means" of the present invention, and decides whether the texture scores calculated by the score calculation unit 212 fall within a predetermined acceptable range or not. At this time, the score decision unit 213 makes a decision referring to information which is stored in the HDD 22 and described below.

A directory for storing information indicating the acceptable range of the texture scores is set in the HDD 22. The directory is referred to as a score information memory unit 221. Information indicating the acceptable range of the respective texture scores set in advance is stored in the score information memory unit 221 prior to actual measurement. The score information memory unit 221 (HDD 22) constitutes "storing means" of the present invention.

In this embodiment, an MPD acceptable range information 221A indicating an acceptable range of an MPD, an accumulated extension ratio acceptable range information 221B indicating an acceptable range of an accumulated extension ratio, and a contact portion ratio acceptable range information 221C indicating an acceptable range of a contact portion ratio are stored in the score information memory unit 221.

It is preferable that the acceptable range information of the respective texture scores be set for each kind of a road surface. For example, by setting the acceptable range information for each kind of pavement such as drainage pavement or dense graded pavement, or by setting the acceptable range information for each characteristic of the composition of the pavement such as maximum particle size (e.g., 13 mm or 5 mm) of aggregate in the asphalt mixture, the texture of various kinds of paved road surfaces can be evaluated. Further, the acceptable range information may be set for each combination of the kind of pavement and the characteristic of the composition of the pavement.

The display unit 23 is formed of a monitor of the (notebook) computer 20, and the audio output unit 24 is formed of a speaker or the like. The display unit 23 and the audio output unit 24 constitute "notifying means" of the present invention. The transmitting/receiving I/F 27 is formed of an interface circuit for transmitting/receiving data and the like.

The power supply circuit 60 is connected to the battery 40. The power supply circuit 60 receives a control signal from the computer 20 to supply power from the battery 40 to the stepping motors 120A, 120B, and 130 and the motors 51A and 51B.

To the stepping motors 120A, 120B, and 130, the power is pulsed, and the stepping motors 120A, 120B, and 130 are rotated by an angle corresponding to the number of the pulses to move the laser displacement meter 11.

To the motors 51A and 51B, the power is supplied for a predetermined period of time to make the laser displacement meter 11 and the like ascend/descend. When stepping motors are used as the motors 51A and 51B, the power is pulsed by a predetermined number to make the laser displacement meter 11 and the like ascend/descend by a predetermined distance.

[Texture Score]

Texture scores of a road surface used in this embodiment are now described in brief. In this embodiment, at least one of an MPD, an accumulated extension ratio, and a contact portion ratio is used as the score. In the following, the three kinds of texture scores are described with reference to FIG. 8 to FIG. 10. It is to be noted that, according to the present invention, an arbitrary score other than those may also be applied.

(MPD)

First, a mean profile depth (MPD) is described. An MPD is commonly used in a method for analyzing the texture of a road surface, and how to calculate an MPD is specified in ISO (see CHARACTERIZATION OF PAVEMENT TEXTURE UTILIZING SURFACE PROFILES PART-1: DETERMINATION OF MEAN PROFILE DEPTH, International Organization for Standardization, International Standard ISO 13473-1, 1996).

An MPD is calculated in the following way for each section (standard length section) determined by dividing each measuring line in measurement using the laser displacement meter 11 by a predetermined length (standard length). First, an average height in the standard length section is determined, the standard length section is divided into two at the center, and the maximum height is determined with regard to each of the divided sections. Then, the difference between the maximum height in each divided section and the average height of the standard length section is calculated, and arithmetic mean of the two differences is determined. The result of the calculation is defined as the MPD of the standard length section.

Figure 8:
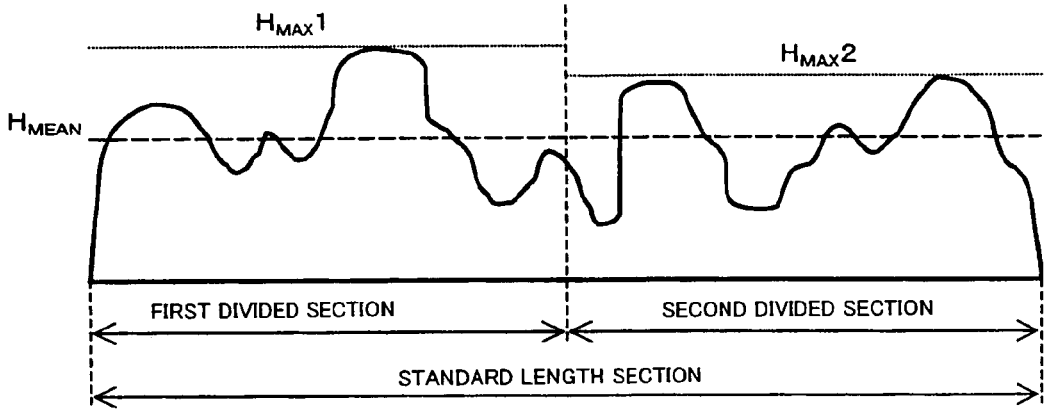
FIG. 8 is an explanatory graph of a method of calculating an MPD performed by the road surface state measuring system according to the embodiment of the present invention.

More specifically, as illustrated in FIG. 8, when the average height of the standard length section is denoted by $H_{MEAN}$ and the maximum heights in the first and second divided sections are denoted by $H_{MAX}1$ and $H_{MAX}2$, respectively, the MPD of the standard length section is expressed as follows:

$$MPD=\{H_{MAX}1-H_{MEAN}\}/2+\{H_{MAX}2-H_{MEAN}\}/2$$

Here, the graph illustrated in FIG. 8 shows displacement in the distance to the road surface (the height of the road surface) in the standard length section measured by the laser displacement meter 11. Therefore, the graph in the figure is a sectional view of the shape of the road surface in the standard length section. It is to be noted that the graph is illustrated with the asperities emphasized.

Suppose that the length of the measuring line in the measurement by the laser displacement meter 11 is 1 m and the standard length is 10 cm. Since the measuring line is divided into ten standard length sections, ten MPDs are obtained with regard to the measuring line.

(Accumulated Extension Ratio)

An accumulated extension ratio is described in, for example, Non-Patent Literature 1. The accumulated extension ratio is now described with reference to FIG. 9. The graph illustrated in the figure shows, similarly to the graph illustrated in FIG. 8, displacement in the height of the road surface (the shape of the road surface) in the standard length sections measured by the laser displacement meter 11. The graph is also illustrated with the asperities emphasized.

An accumulated extension ratio is calculated in the following way. First, the maximum height in each standard length section of the measuring line is determined, and height lower than the maximum height by a predetermined length (hereinafter referred to as lower limit height) is determined. Then, in each standard length section, the length of the road surface (including asperities) within a measurement range where the height exceeds the lower limit height is determined, and the determined lengths are summed up with regard to all the standard length sections. Further, the result of the calculation is divided by the length of the measuring line, which is defined as the accumulated extension ratio of the measuring line.

Figure 9:
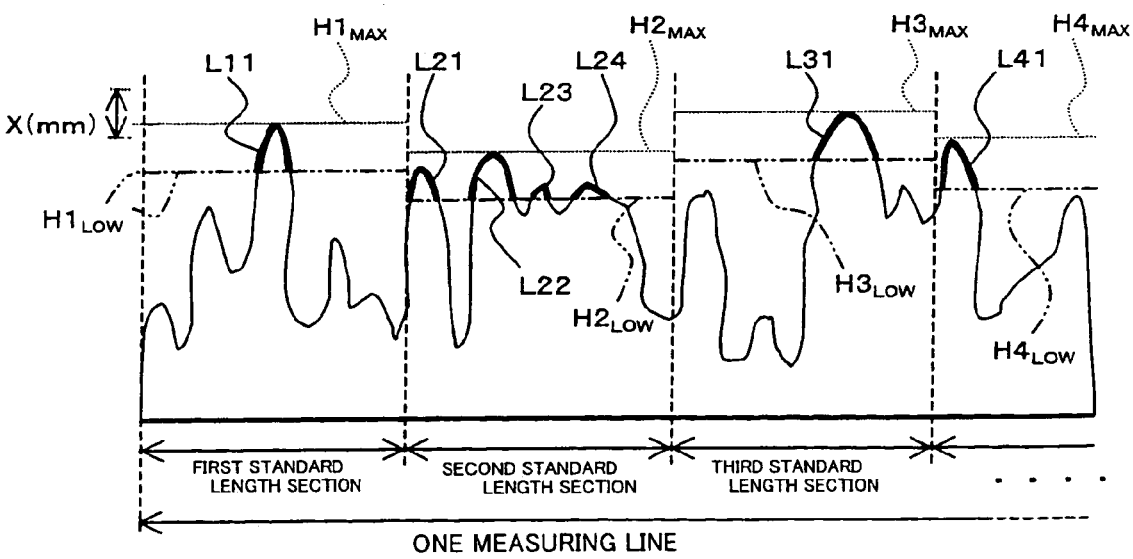
FIG. 9 is an explanatory graph of a method of calculating an accumulated extension ratio performed by the road surface state measuring system according to the embodiment of the present invention.

The calculation illustrated in FIG. 9 is now specifically described. First, one measuring line is divided into a first standard length section, a second standard length section, a third standard length section, . . . , and the above-described predetermined length from the maximum height to the lower limit height is set as ×mm (for example, 2 mm). The maximum heights $H1_{MAX}$, $H2_{MAX}$, $H3_{MAX}$, . . . in the standard length sections are respectively determined, and the lower limit heights $H1_{LOW}$, $H2_{LOW}$, $H3_{LOW}$, . . . in the standard length sections are respectively determined.

With regard to the first standard length section, a length L11 of the road surface in a measurement range where the height exceeds the lower limit height $H1_{LOW}$ is determined. More specifically, in the first standard length section of the graph of FIG. 9, the length L11 of the graph in the measurement range where the value is between $H1_{MAX}$ and $H1_{LOW}$ is determined. With regard to the second standard length section, since there are four measurement ranges where the height exceeds the lower limit height $H2_{LOW}$, lengths L21, L22, L23, and L24 of the road surface of the four measurement ranges are determined. Similarly, with regard to the third standard length section, the fourth standard length section, . . . , lengths of the road surface in measurement ranges where the height exceeds the lower limit height are determined.

Further, the heights of the road surface determined with regard to the respective standard length sections are summed up, and the result of the calculation is divided by the length of the measuring line (L), thereby determining the accumulated extension ratio of the measuring line. More specifically, the accumulated extension ratio of the measuring line is given by (L11+L21+L22+L23+L24+L31+L41+ . . . )/L.

(Contact Portion Ratio)

A contact portion ratio is described in, for example, Non-Patent Literature 2. The contact portion ratio is now described with reference to FIG. 10. The graph illustrated in the figure shows, similarly to the graph illustrated in FIG. 9, displacement in the height of the road surface (the shape of the road surface) in the standard length sections measured by the laser displacement meter 11. This graph is also illustrated with the asperities emphasized.

Similarly to the case of the accumulated extension ratio, a contact portion ratio is calculated in the following way. First, the maximum height in each standard length section of the measuring line is determined, and height lower than the maximum height by a predetermined length (lower limit height) is determined. Then, in each standard length section, the length of the measurement range where the height exceeds the lower limit height, and the lengths are summed up with regard to all the standard length sections. Further, the result of the calculation is divided by the length of the measuring line, which is defined as the contact portion ratio of the measuring line.

It is to be noted that the accumulated extension ratio and the contact portion ratio have in common that they are obtained taking into consideration measurement ranges where the height exceeds the lower limit height, but they are different from each other in that, while the accumulated extension ratio is calculated based on the total sum of the lengths of the road surface (generally, curves, crooked lines, and the like) in the measurement ranges, the contact portion ratio is calculated based on the total sum of the measurement ranges (straight lines).

Figure 10:
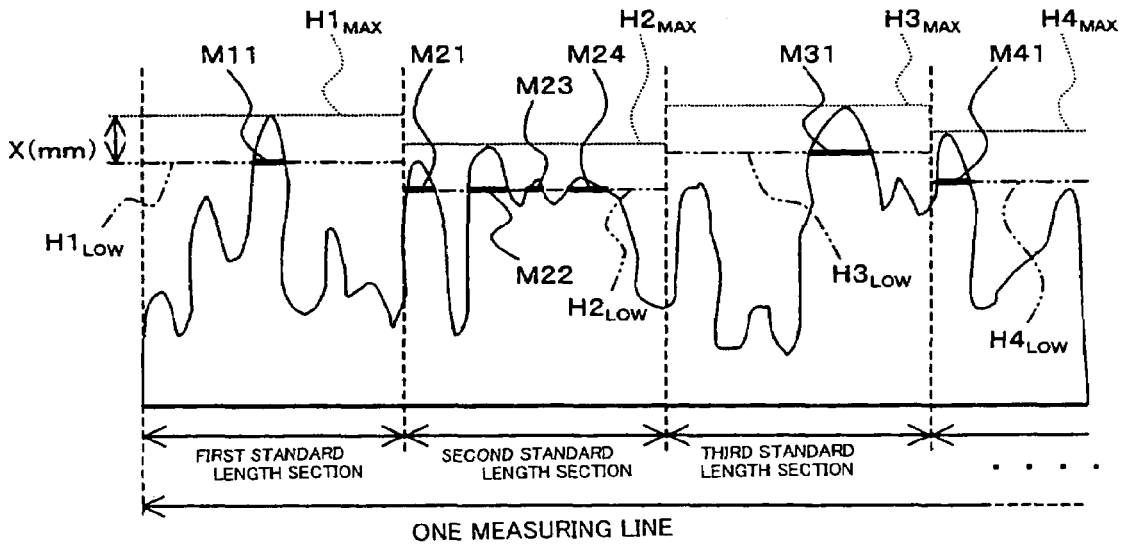
FIG. 10 is an explanatory graph of a method of calculating a contact portion ratio performed by the road surface state measuring system according to the embodiment of the present invention.

The calculation illustrated in FIG. 10 is now specifically described. First, one measuring line is divided into a first standard length section, a second standard length section, a third standard length section, . . . , and the above-described predetermined length from the maximum height to the lower limit height is set as X mm. The maximum heights $H1_{MAX}$, $H2_{MAX}$, $H3_{MAX}$, . . . in the standard length sections are respectively determined, and the lower limit heights $H1_{LOW}$, $H2_{LOW}$, $H3_{LOW}$, . . . in the standard length sections are respectively determined.

With regard to the first standard length section, a length M11 of a measurement range where the height exceeds the lower limit height $H1_{LOW}$ is determined. More specifically, in the first standard length section of the graph of FIG. 10, the length M11 of the measurement range where the value is between $H1_{MAX}$ and $H1_{LOW}$ is determined. With regard to the second standard length section, since there are four measurement ranges where the height exceeds the lower limit height $H2_{LOW}$, lengths M21, M22, M23, and M24 of the four measurement ranges are determined. Similarly, with regard to the third standard length section, the fourth standard length section, . . . , lengths of the measurement ranges where the height exceeds the lower limit height are determined.

Further, the heights of the measurement ranges determined with regard to the respective standard length sections are summed up, and the result of the calculation is divided by the length of the measuring line (L), thereby determining the contact portion ratio of the measuring line. More specifically, the contact portion ratio of the measuring line is given by (M11+M21+M22+M23+M24+M31+M41+ . . . )/L.

[Processing Mode]

Figure 11:
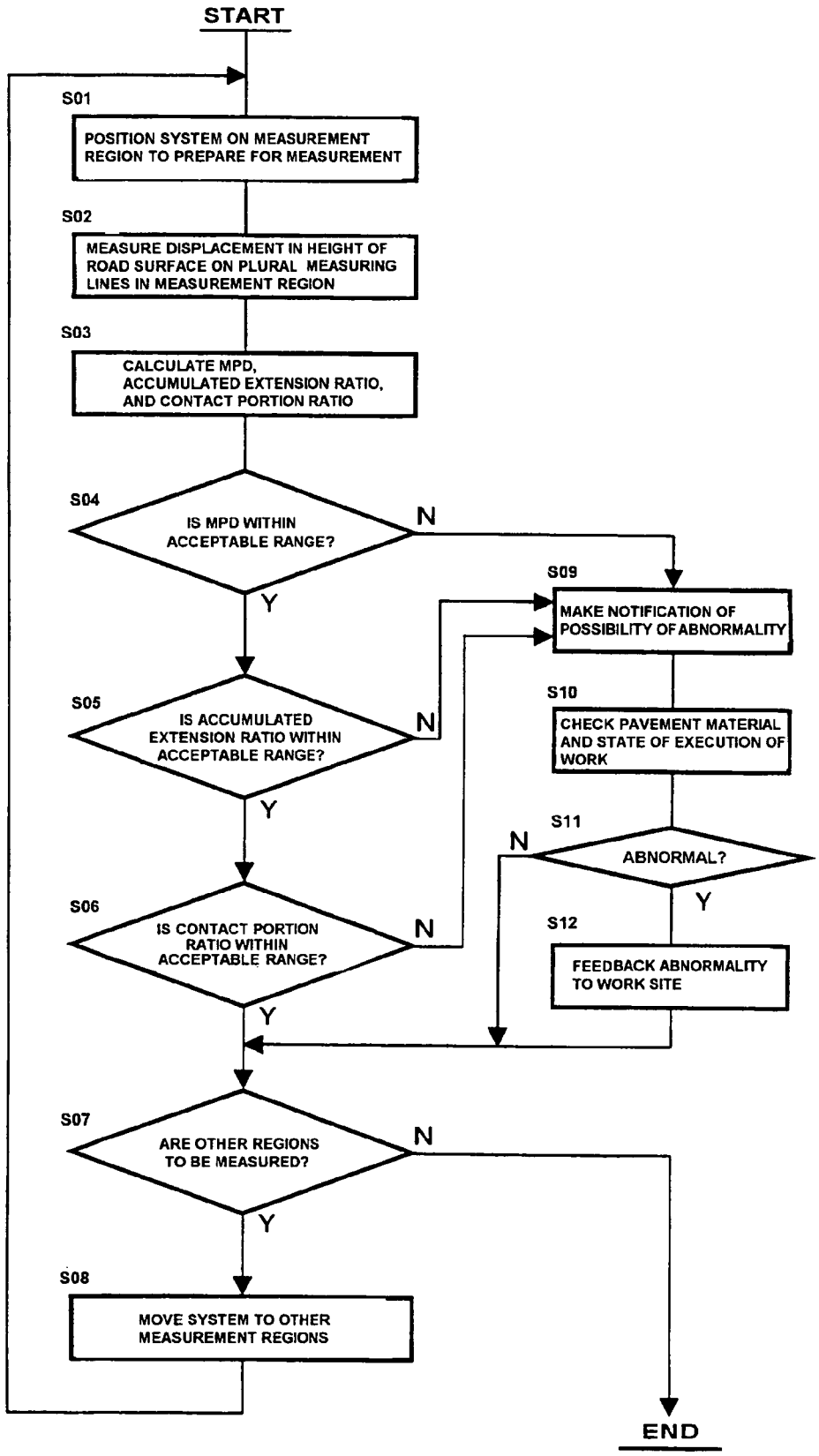
FIG. 11 is a flow chart illustrating an exemplary workflow using the road surface state measuring system according to the embodiment of the present invention.

A mode of estimation processing of the texture of a road surface implemented by the road surface state measuring system 1 having the above-described structure is now described based on a workflow using the system 1. An example of workflow using the road surface state measuring system 1 is illustrated in FIG. 11. The present invention can be, for example, suitably utilized at a work site where the work is being executed, and a flow chart illustrated in FIG. 11 shows an application example of the system 1 at a work site where the work is being executed.

(Preparation for Measurement: S01)

When the system 1 is used, first, the system 1 is positioned on a target measurement region of the road surface. Here, the system 1 is positioned such that the direction of a measuring line coincides with the main scanning direction.

An operator operates the power button 31 of the control box 30 to turn on the system 1 (in particular, the measurement body portion 10) and start up the computer. Next, the operator operates the down button 33B of the control box 30. In response to the operation of the down button 33B, the control unit 211 controls the motors 51A and 51B (i.e., controls the power supply circuit 60 to supply power to the motors 51A and 51B), and makes the laser displacement meter 11 and the like descend to the predetermined position near the road surface to prepare for the measurement.

(Measurement of Height of Road Surface: S02)

When the operator operates the measurement start button 34A of the control box 30, the control unit 211 of the computer 20 controls the laser displacement meter 11 and the stepping motors 120A, 120B, and 130 to carry out the following measurement. It is to be noted that the control of the stepping motors 120A, 120B, and 130 is carried out by controlling the power supply circuit 60 to supply a pulsed power signal to the respective stepping motors.

Figure 12:
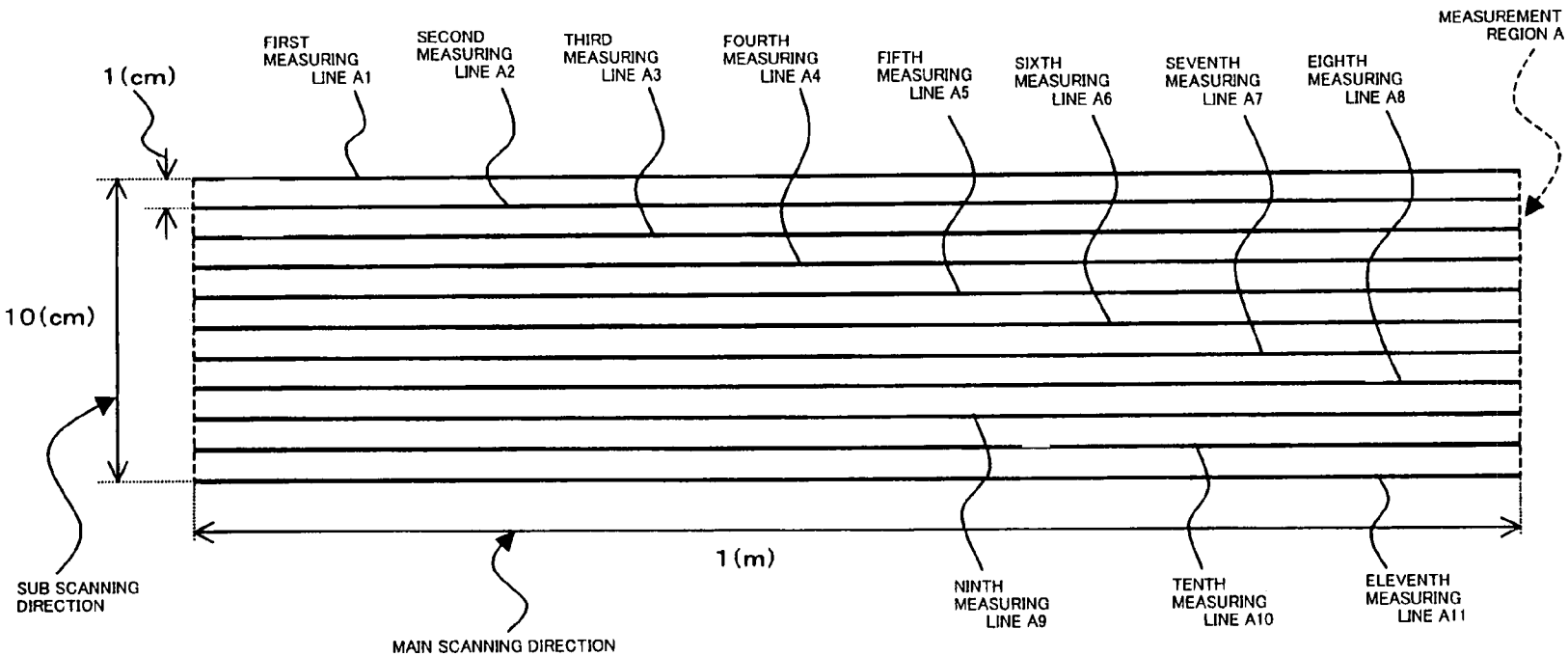
FIG. 12 is an explanatory view of a mode of measurement performed by the road surface state measuring system according to the embodiment of the present invention.

As illustrated in FIG. 12, with respect to the target measurement region A, first to eleventh measuring lines A1 to A11 which are 1 m in length are set at one-centimeter intervals. In other words, the measurement region A is set as a range of (1 m in the main scanning direction)×(10 cm in the sub scanning direction) It is to be noted that the length, the number, and the intervals of the measuring lines can be arbitrarily set, for example, through operation of the computer 20 or the control box 30.

Figure 13:
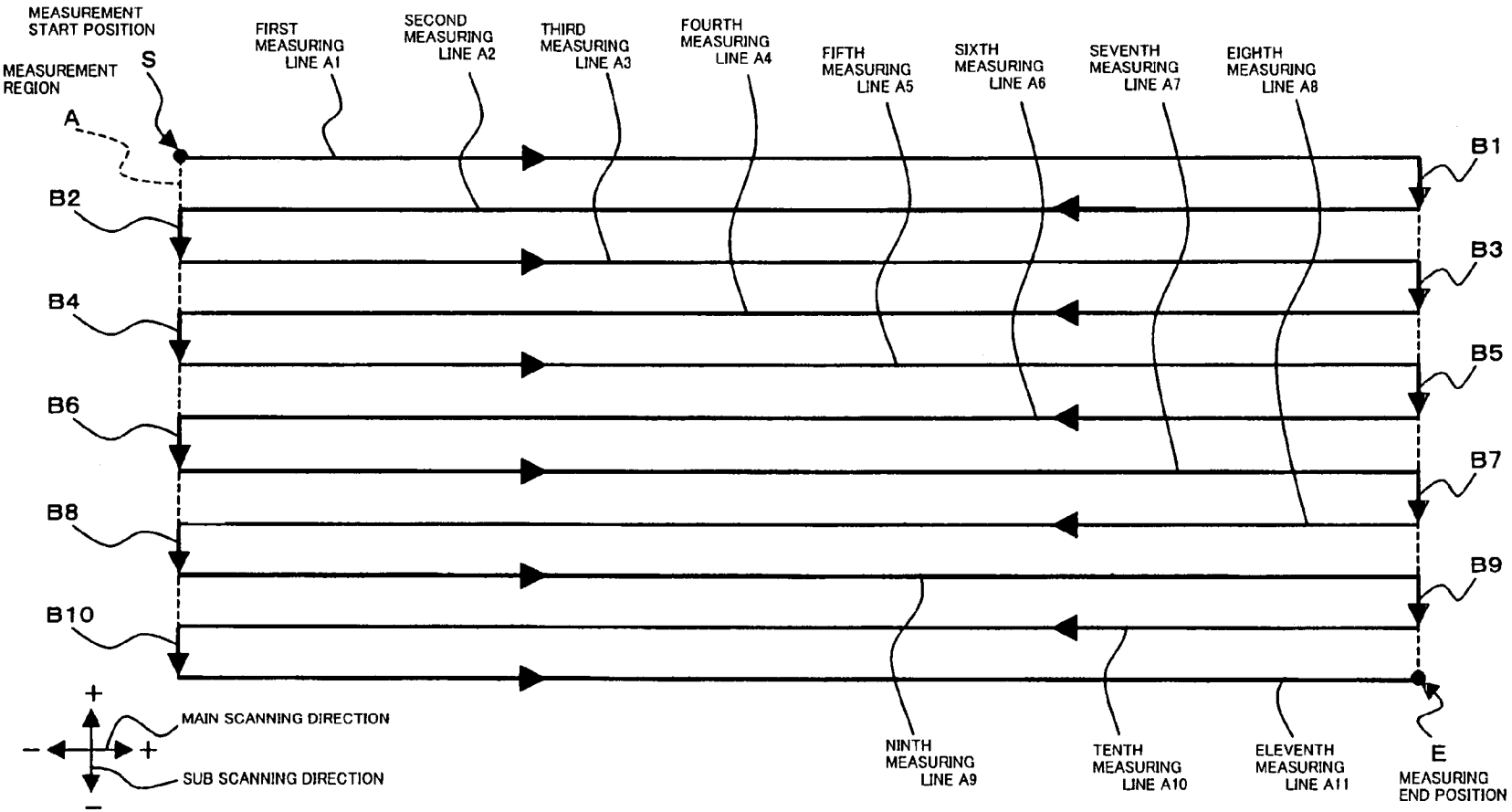
FIG. 13 is an explanatory view of a mode of measurement performed by the road surface state measuring system according to the embodiment of the present invention.

FIG. 13 is a plan view illustrating an example of mode of scanning the measurement positions of the laser displacement meter 11 in the measurement region A illustrated in FIG. 12. The control unit 211 in advance controls the stepping motors 120A, 120B, and 130 to move the laser displacement meter 11 such that its measurement position corresponds to a measurement start position S.

As illustrated in FIG. 13, a horizontal direction in the figure is the main scanning direction. A rightward direction in the figure is denoted as "(+) main scanning direction", while a leftward direction in the figure is denoted as "(−) main scanning direction". A vertical direction in the figure is the sub scanning direction. An upward direction in the figure is denoted as "(+) sub scanning direction", while a downward direction in the figure is denoted as "(−) sub scanning direction".

When the measurement start button 34A is operated, the control unit 211 controls the stepping motors 120A and 120B to move the laser displacement meter 11 in the (+) main scanning direction. While scanning the measurement positions of the laser displacement meter 11 along a first measuring line A1, the laser displacement meter 11 measures the distance to the road surface at predetermined measurement intervals (e.g., at 0.1-milimeter intervals). Thus, displacement in the height of the road surface on the first measuring line A1 is obtained. The result of the measurement is transmitted to the computer 20, and is stored in, for example, the HDD 22 or the RAM 26.

After the scanning along the first measuring line A1 is completed, the control unit 211 controls the stepping motor 130 to move the laser displacement meter 11 in the (−) sub scanning direction by 1 cm as shown by an arrow B1. Here, measurement by the laser displacement meter 11 is stopped by the control unit 211.

After the movement of the laser displacement meter 11 as shown by the arrow B1 is completed, the control unit 211 controls the stepping motors 120A and 120B to move the laser displacement meter 11 in the (−) main scanning direction. While scanning the measurement positions along a second measuring line A2, the laser displacement meter 11 continuously measures the distance to the road surface at the above-described measurement intervals. Thus, displacement in the height of the road surface on the second measuring line A2 is obtained. The result of the measurement is transmitted to the computer 20, and is stored in, for example, the HDD 22 or the RAM 26.

After the scanning along the second measuring line A2 is completed, the control unit 211 controls the stepping motor 130 to move the laser displacement meter 11 in the (−) sub scanning direction by 1 cm as shown by an arrow B2. Here, measurement by the laser displacement meter 11 is stopped by the control unit 211.

Similarly, the control unit 211 moves the laser displacement meter 11 along a third measuring line A3, an arrow B3, a fourth measuring line A4, an arrow B4, a fifth measuring line A5, an arrow B5, a sixth measuring line A6, an arrow B6, a seventh measuring line A7, an arrow B7, an eighth measuring line A8, an arrow B8, a ninth measuring line A9, an arrow B9, a tenth measuring line A10, an arrow B10, and an eleventh measuring line A11 in the stated order to a measuring end position E. The laser displacement meter 11 is controlled by the control unit 211 so as to obtain the displacement in the height of the road surface when moving along the respective measuring lines A3 to A11, while the laser displacement meter 11 is controlled to stop the measurement when moving along the respective arrows B3 to B10.

By such measurement processing, with regard to the measurement region A, measurement data on the eleven measuring lines A1 to A11 is automatically obtained. The obtained measurement data may be displayed on the display unit 23 of the computer 20. In this case, a graph showing the state of displacement (asperities) in the height of the road surface such as those illustrated in FIGS. 8 to 10 is displayed on the display unit 23.

(Calculation of Texture Score: S03)

Next, the score calculation unit 212 of the computer 20 calculates the MPDs, accumulated extension ratios, and contact portion ratios based on the measurement data of the height of the road surface along the plurality of measuring lines A1 to A11 obtained at step S02. Here, the score calculation unit 212 divides the measurement data on each of the measuring lines A1 to A11 into ten pieces of subdata corresponding to the ten standard length sections according to the method described in the above [Texture score] section and calculates the respective scores. The calculated texture scores are stored in, for example, the HDD 22 or the RAM 26. The calculated texture scores may be displayed on the display unit 23 of the computer 20.

Further, in the processing by the score calculation unit 212, a mean value of the plurality of calculated texture scores may be determined. As will be described in detail below, while the plurality of calculated texture scores exhibit dispersion (variation) to some extent, their mean value satisfactorily reflects the texture of the whole road surface, so the reliability of the evaluation can be improved by using the mean value. It is to be noted that the mean value of the MPDs is calculated from 110 calculated values while the mean value of the accumulated extension ratios and the mean value of the contact portion ratios are calculated from eleven calculated values, respectively.

In step S02, the measurement data of the distance to the road surface (the height of the road surface) obtained by the laser displacement meter 11 translated with respect to the road surface along the respective measuring lines A1 to A11 is "measurement data columns" of the present invention. In this embodiment, eleven measurement data columns are obtained.

In step S03, subdata obtained by dividing a measurement data column into standard length sections corresponds to a "subdata column" of the present invention.

As described above, when the respective measuring lines A1 to A11 are 1 m in length and the measurement intervals are 0.1 mm, 10,000 measurement positions are set on each of the measuring lines A1 to A11, and thus, measurement data (a measurement column) corresponding to each measuring line contains 10,000 measured values. When the respective standard length sections are 10 cm in length, subdata (a subdata column) corresponding to each standard length section contains 1,000 measured values.

(Decision of Texture Score Suitability: S04, S05, and S06)

After the texture scores are calculated, the score decision unit 213 of the computer 20 decides the suitability of the respective texture scores. More specifically, the score decision unit 213 carries out the following decision processing.

The score information memory unit 221 of the HDD 22 stores in advance the MPD acceptable range information 221A, the accumulated extension ratio acceptable range information 221B, and the contact portion ratio acceptable range information 221C indicating acceptable ranges of the MPD, accumulated extension ratio, and contact portion ratio, respectively. The acceptable range information 221A to 221C is formed of, for example, information indicating acceptable maximum values as the respective scores. The acceptable ranges of the respective scores are obtained experimentally by, for example, forming pavement with various states of a road surface actually or in computer simulation and reviewing the respective texture scores.

First, with regard to the MPD (step S04), the score decision unit 213 compares the MPD calculated at step S03 with the maximum value of the MPD indicated by the MPD acceptable range information 221A. When the former is equal to or smaller than the latter, the score decision unit 213 decides that it is "acceptable (normal)" (S04, YES). When the former is greater than the latter, the score decision unit 213 decides that it is "unacceptable (there is a possibility of abnormality" (S04, NO). When it is decided to be normal, the processing proceeds to step S05, and when it is decided that there is a possibility of abnormality, the processing proceeds to step S09.

Similarly, with regard to the accumulated extension ratio (step S05), the score decision unit 213 compares the accumulated extension ratio calculated at step S03 with the maximum value of the accumulated extension ratio indicated by the accumulated extension ratio acceptable range information 221B. When the former is equal to or smaller than the latter, the score decision unit 213 decides that it is "acceptable (normal)" (S05, YES). When the former is greater than the latter, the score decision unit 213 decides that it is "unacceptable (there is a possibility of abnormality" (S05, NO). When it is decided to be normal, the processing proceeds to step S06, and when it is decided that there is a possibility of abnormality, the processing proceeds to step S09.

Similarly, with regard to the contact portion ratio (step S06), the score decision unit 213 compares the contact portion ratio calculated at step S03 with the maximum value of the contact portion ratio indicated by the contact portion ratio acceptable range information 221C. When the former is equal to or smaller than the latter, the score decision unit 213 decides that it is "acceptable (normal)" (S06, YES). When the former is greater than the latter, the score decision unit 213 decides that it is "unacceptable (there is a possibility of abnormality" (S06, NO). When it is decided to be normal, the processing proceeds to step S07, and when it is decided that there is a possibility of abnormality, the processing proceeds to step S09.

The result of decision with regard to the suitability of the respective texture scores by the score decision unit 213 may be displayed on the display unit 23 of the computer 20.

When a mean value of a plurality of texture scores is calculated at step S03, whether the mean value is included in the acceptable range or not is decided. When such a mean value is not calculated, at least one of the plurality of texture scores is the subject of the decision. In the latter case, if two or more texture scores are the subject of the decision, the reliability of the estimation is improved compared with a conventional case.

(Presence or Absence of Measurement with Regard to other Regions: S07 and S08)

Step S06 is the end of the processing with regard to the measurement region A. When the measurement with regard to the measurement region A is completed, the operator decides whether measurement is carried out with regard to other regions on the road surface or not (S7). This decision is made, for example, according to a measurement schedule prepared in advance.

When no further measurement is carried out after the measurement with regard to the measurement region A is completed (S07, NO), the operator operates the power button 31 of the control box 30 to turn off the measurement body portion 10 and turns off the computer 20 to complete the measurement using the road surface state measuring system 1.

On the other hand, when measurement is carried out subsequently with regard to other regions (S07, YES), when necessary, the operator turns off the measurement body portion 10 and the computer 20. Then, the operator moves the road surface state measuring system 1 to other measurement regions (S08) to carry out the measurement in a similar way.

(Processing when Texture Score is not Included in Acceptable Range: S09 to S12)

When it is decided that there is a possibility of abnormality at step S04, S05, or S06 (S04, NO; S05, NO; or S06, NO), the control unit 211 of the computer 20 notifies the operator of the decision (S08). As specific modes of the notification processing, for example, a warning message can be displayed on the display unit 23 saying it is necessary to check the material of pavement of the road surface and the state of the execution of work, or a similar warning message or beep tones can be outputted through the audio output unit 24.

The operator can notice the possibility of abnormality through the above notification processing, and can, for example, check the particle size, shape, and composition of the aggregate used in the pavement, the suitability of roller compaction processing, and the like (S10).

When abnormality is found through checking the pavement material and the state of the execution of work (S11, YES), details of the abnormality can be analyzed to be fed back to the work site (S12). For example, when paving of a part of a region to be paved is completed, the road surface state measuring system 1 does the estimation with regard to that part. When an abnormality notification is made, paving of other part is temporarily stopped, and the cause of the abnormality is analyzed. When the cause of the abnormality is identified, it is possible to correct the execution of work, for example, by replacing the aggregate or by appropriately carrying out roller compaction processing. Therefore, not only the quality of the pavement can be improved but also time and cost to redo paving can be saved.

[Action and Effect]

Action and effects of the above-described road surface state measuring system 1 are now described.

The road surface state measuring system 1 can move the laser displacement meter 11 two-dimensionally by moving the laser displacement meter 11 independently in the main scanning direction and in the sub scanning direction. This allows measurement with regard to a measurement region on road surface not along only a single measuring line as in conventional measurement but along a plurality of measuring lines.

When the number of the standard length sections in a measuring line is the same (for example, ten standard length sections), while only ten MPDs, one accumulated extension ratio, and one contact portion ratio can be obtained, respectively, in conventional measurement along only a single measuring line; by the scanning according to this embodiment (see FIG. 13), 10×11=110 MPDs, 1×11=11 accumulated extension ratios, and 1×11=11 contact portion ratios can be obtained, respectively.

Therefore, according to the present invention, since more texture scores than those of conventional measurement can be obtained, statistically more accurate measurement can be carried out and the reliability of texture estimation can be improved.

Since the measurement intervals of the height of the road surface by the laser displacement meter 11 is, similarly to a conventional case, set to be, for example, 0.1 mm, the accuracy of measurement along a respective measuring line is not reduced. It is to be noted that, in implementing the present invention, it is practically preferable to use a laser displacement meter the measurement speed of which is high to avoid taking a long time to carry out the measurement.

Further, by carrying out the measurement along a plurality of measuring line, data can be collected from a wider range than in a conventional case, and, compared with conventional measurement, texture estimation more satisfactorily reflecting the state of the whole road surface can be conducted.

Further, since a plurality of values are calculated with regard to the respective texture scores and mean values thereof are determined, and the mean values are used to estimate the state of the texture of the road surface, the reliability of texture estimation can be improved (the reason is described below).

Further, since the road surface state measuring system 1 is configured to estimate the texture of a road surface taking into consideration scores of a plurality of kinds such as an MPD, an accumulated extension ratio, and a contact portion ratio, comprehensive and highly reliable texture estimation can be materialized.

Still further, as illustrated in the flow chart of FIG. 11, since the road surface state measuring system 1 is configured to decide whether the determined texture scores are within the acceptable range or not. If it decides that they are outside the acceptable range, a notification is made, and it can be easily known that an abnormal event may have occurred. Then, the cause of the possible abnormality can be found in situ, a feedback can be made in real time, and the execution of work can be corrected. Accordingly, the present invention is expected to be effectively utilized in situ. In particular, by making a notification when the plurality kinds of the texture scores are outside the range, comprehensive texture estimation can be conducted in situ.

(Comparison with Conventional Texture Estimation)

The texture estimation according to the present invention and the conventional one are compared to prove the effectiveness of the present invention.

FIG. 14 shows the result of measurement of MPDs obtained by the road surface state measuring system 1 of this embodiment with regard to drainage pavement with the maximum particle size of the aggregate being 13 mm (referred to as "13 mm" or "drainage 13 mm"), drainage pavement with the maximum particle size of the aggregate being 5 mm (referred to as "5 mm" or "drainage 5 mm"), and dense graded pavement with the maximum particle size of the aggregate being 13 mm (referred to as "dense graded"). The measurement was carried out setting eleven measuring lines in a region of 1 m×10 cm, as illustrated in FIG. 12.

Figures 14A, 14B:
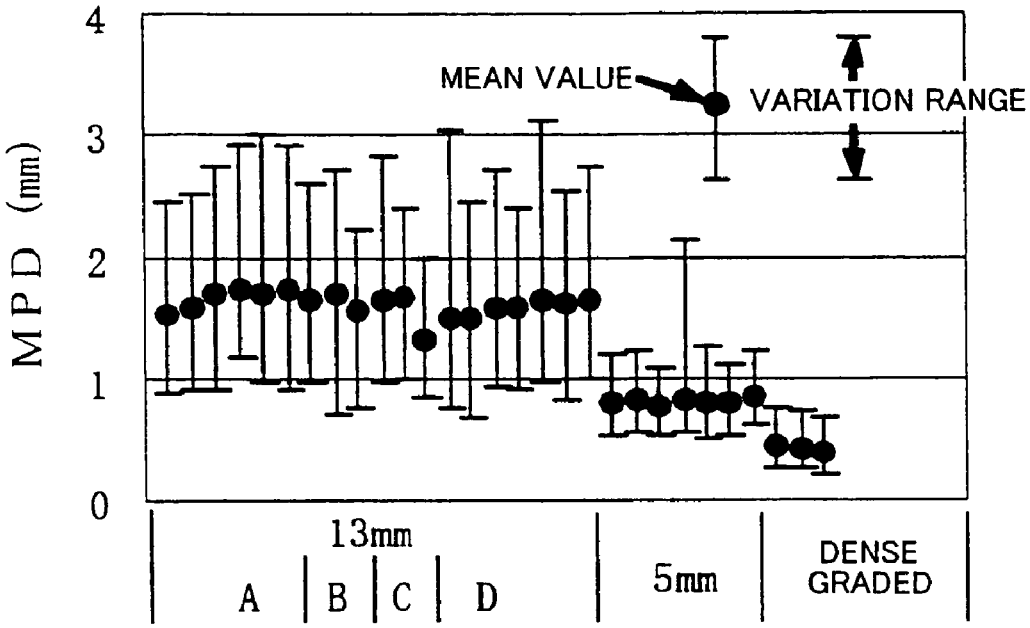
FIG. 14A is an explanatory graph illustrating an exemplary state of variation of MPDs obtained based on measurement with regard to various kinds of pavements for reviewing the effectiveness of the texture measuring of a road surface according to the present invention.
FIG. 14B is a table of statistical data calculated from the state of variation of the MPDs for reviewing the effectiveness of the texture measuring of the road surface according to the present invention.

Measurement was carried out along eleven measuring lines with regard to 19 measurement regions as for "13 mm", with regard to 7 measurement regions as for "5 mm", and with regard to 3 measurement regions as for "dense graded". Ten MPDs were determined with regard to respective measuring lines, mean values thereof (referred to as mean value MPDs) were calculated, and the dispersion (variation range) of the eleven mean value MPDs and mean values of the eleven mean value MPDs are shown in FIG. 14A. With regard to "13 mm", the measurement was carried out in regard to four places of pavement A to D. FIG. 14B shows mean values of mean value MPDs, coefficients of variation (=(standard deviation)/(mean value)) of the mean value MPDs, and mean values of the variation range calculated from the measurement with regard to the respective pavement.

As can be seen from the result of measurement illustrated in the figures, there is a large dispersion in the eleven mean value MPDs in the respective measurement regions. This means that, the obtained MPDs vary depending on which position in the measurement region (which measuring line) is selected for the estimation. More specifically, the variation range with regard to "dense graded" was 0.47 mm, which was the smallest, and the variation range with regard to "5 mm" comes next with 0.77 mm. With regard to "13 mm", the variation range is as large as 1.75 mm.

Further, as can be seen from, for example, the result of measurement with regard to Pavement A of "13 mm", depending on where on the same paved road surface the measurement region is set, the obtained MPDs vary not a little.

Therefore, in conventional measurement along only a single measuring line, depending on not only the position of the measurement region on the road surface but also the position of the measuring line in the measurement region, considerable errors can occur in the result of measurement, and thus, it is difficult to guarantee the reliability of the texture estimation.

With regard to mean values of the respective measurement regions shown in FIG. 14A, for example, the variation among the six mean values of Pavement A of "13 mm" is not substantially large. In the above embodiment according to the present invention, it is thought that, since the mean value is calculated and the texture is estimated using the mean value, estimation more reliable than conventional one can be conducted.

Figure 15A:
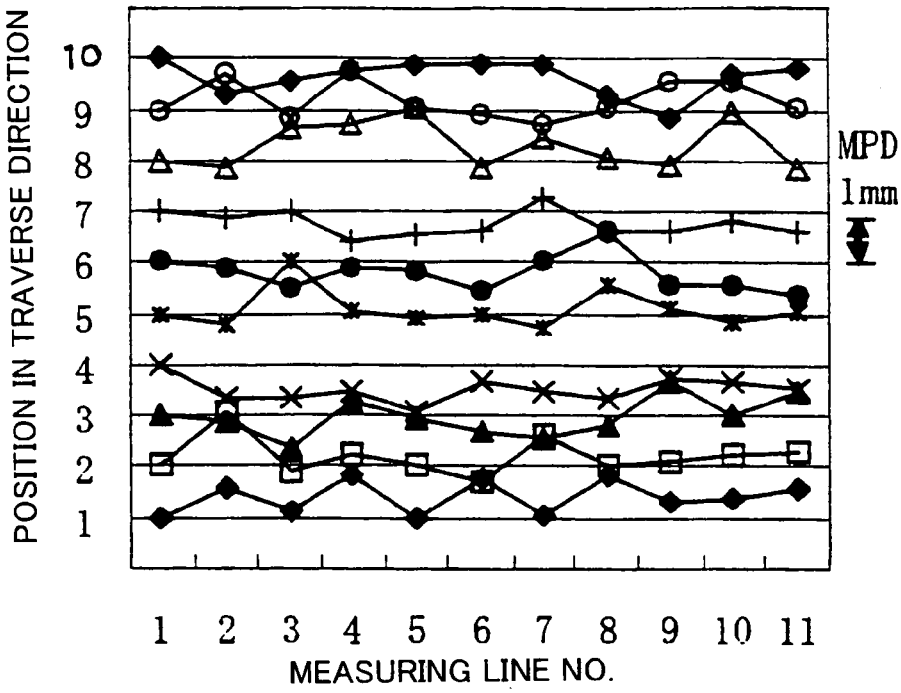
FIG. 15A is a graph illustrating an exemplary state of variation in a traverse direction of the MPDs obtained with regard to a measurement region for reviewing the effectiveness of the texture estimation of a road surface according to the present invention.
Figure 15B:
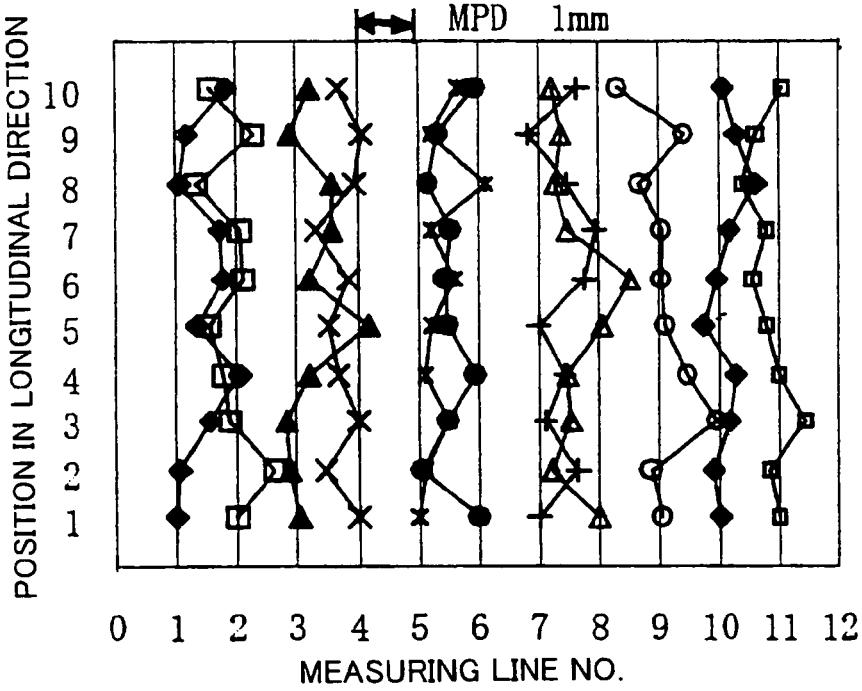
FIG. 15B is a graph illustrating an exemplary state of variation in a longitudinal direction of the MPDs obtained with regard to the measurement region for reviewing the effectiveness of the texture estimation of the road surface according to the present invention.

FIG. 15 shows the state of variation among 110 MPDs obtained with regard to a measurement region of 1 m×10 cm of "13 mm". FIG. 15A shows the state of variation in the traverse direction (sub scanning direction), while FIG. 15B shows the state of variation in the longitudinal direction (main scanning direction, direction of the measuring lines). Measurement for obtaining the result shown in the figures was conducted with regard to reference road surface the data of which such as the material used and the composition of the pavement is known.

As can be seen from FIGS. 15A and 15B, MPDs in the measurement region are distributed randomly both in the traverse direction and in the longitudinal direction. Accordingly, with conventional measurement along only a single measuring line, even a measurement region of 1 m×10 cm is difficult to be effectively estimated. Similar measurement was conducted with regard to "5 mm" and "dense graded", and similar tendency was observed.

In this way, it can be seen that texture scores obtained by a conventional method for estimating the texture of a road surface from the result of measurement along only a single measuring line has a reliability problem.

The present invention attempts to improve the reliability of estimation by measuring the texture of a road surface not as a "line" as in a conventional case but as a "plane". In the following, the effectiveness of the measurement and the measuring method according to the present invention and the number of samples of the texture scores necessary for estimating the "plane" are reviewed.

For that purpose, with regard to a measurement region of 1 m×10 cm of pavement of "13 mm", 101 measuring lines were set with a pitch of 1 mm to collect 1,010 MPDs. FIG. 16 shows the result of the measurement.

Figures 16A, 16B, 16C:
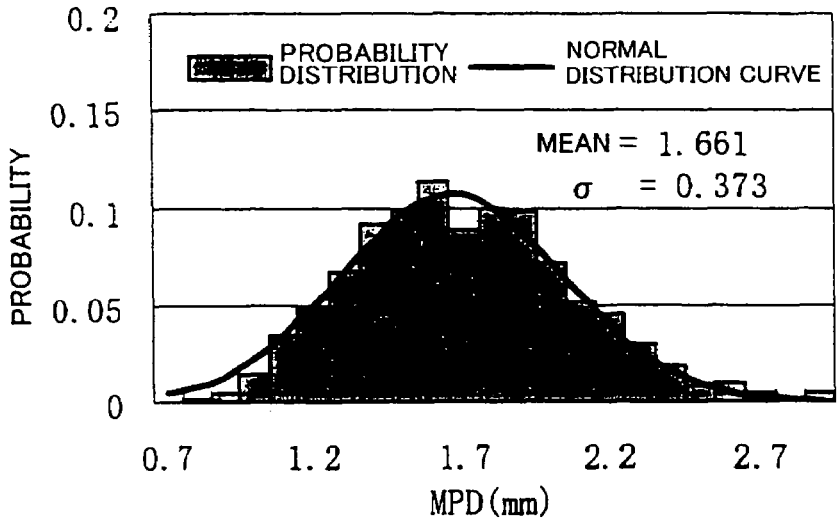
FIG. 16A is a graph showing a distribution of the MPDs obtained with regard to the measurement region for reviewing the number of samples necessary for effectively estimating the texture of a road surface.
FIG. 16B is a table showing the result of calculation of interval estimation for a population mean with regard to the distribution of the MPDs for reviewing the number of samples necessary for effectively measuring the texture of the road surface.
FIG. 16C is a table showing the accuracy of the estimation when 110 MPDs were used to estimate the texture of a road surface for reviewing the number of samples necessary for effectively estimating the texture of the road surface.

A histogram of FIG. 16A shows distribution of MPDs collected by the measurement. As shown in the figure, distribution of the MPDs is similar to a normal distribution, and thus, the distribution is assumed to be a normal distribution to do interval estimation of a population mean.

FIG. 16B shows the result of interval estimation of a 95% confidence interval for the population mean with regard to the distribution of the MPDs shown in FIG. 16A. Results based on similar measurement with regard to "5 mm" and "dense graded" are also shown in the figure.

As can be seen from FIG. 16B, since the width between the minimum value and the maximum value of the population mean $\mu$ is sufficiently small and the dispersion is small, the whole road surface as the population can be sufficiently estimated with the data collected by the measurement. It was found that, therefore, by collecting 1,010 MPDs by setting 101 measuring lines in a measurement region of 1 m×10 cm, the texture of a road surface could be estimated with high reliability.

Next, the number of samples necessary for effectively estimating the texture is reviewed. As can be seen from the mean values of the mean value MPDs in the table of FIG. 14B, when "5 mm" has an error of −0.2 mm and "dense graded" has an error of +0.2 mm, it is difficult to differentiate them using the MPDs. The number of MPD samples necessary for obtaining the MPDs with an error of 0.1 mm was determined to be 93 with regard to "13 mm". FIG. 16C shows the accuracy when 110 MPDs were obtained as in the above embodiment with regard to "13 mm", "5 mm", and "dense graded".

Though not described in detail here, according to measurement carried out by the inventors of the present invention, MPDs, accumulated extension ratios, and contact portion ratios showed very high correlation coefficients with each other, and, based on the measurement with regard to "13 mm", the coefficient of variation of MPDs was found to be larger than those of accumulated extension ratios and contact portion ratios. Since the reliability was found to be high with regard to MPDs, it can be assumed that, with this condition, accumulated extension ratios and contact portion ratios are also highly reliable.

In this way, according to the present invention, by two-dimensionally scanning a measurement region of a (road surface to obtain about 100 texture scores (MPDs, accumulated extension ratios, contact portion ratios, and the like), the texture of the road surface as a "plane" can be estimated, and the reliability of estimation can be improved.

[Variation]

The structure described in detail above is only an example for suitably implementing the present invention, and variations may be made within the spirit of the present invention.

For example, the mode of scanning the measurement positions by the laser displacement meter is not limited to the one illustrated in FIG. 12, and, for example, a plurality of measuring lines may be scanned as a result such as scanning in the same direction along the respective measuring lines, eventually it may be such as the laser displacement meter which carries out scanning two-dimensionally.

Further, the structure for moving the laser displacement meter in parallel with the road surface (scanning means) is not limited to the above-described not only ball screw, stepping motors, rails, and the like, but also any arbitrary structure can be used which can translate the laser displacement meter two-dimensionally.

Further, though the above embodiment is configured to use all the MPDs, accumulated extension ratios, and contact portion ratios as the texture scores, it is sufficient to use at least one of the three kinds according to the present invention. It is preferable, however, that a plurality of kinds of such scores are used to comprehensively estimate the texture.

Still further, it is also possible to use devices other than the laser displacement meter as the measuring means for measuring the distance to the road surface.

[Modified Example of Scanning Mode of Measuring Means]

FIG. 17 illustrates a schematic structure of a road surface state measuring system in which the measuring means (e.g., a laser displacement meter) is moved in a scanning mode different from that of the above-described embodiment. By the structure illustrated in the figure, a plurality of measurement data columns along concentric measuring lines, and further, a measurement data column along a spiral measuring line can be obtained.

(Structure)

Figure 17A:
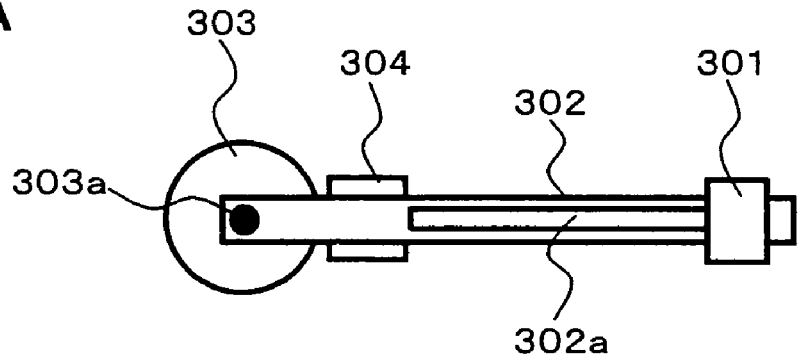
FIG. 17A is a schematic bottom view illustrating an exemplary structure for making the laser displacement meter scan in a road surface state measuring system according to a modified example of the embodiment of the present invention.
Figure 17B:
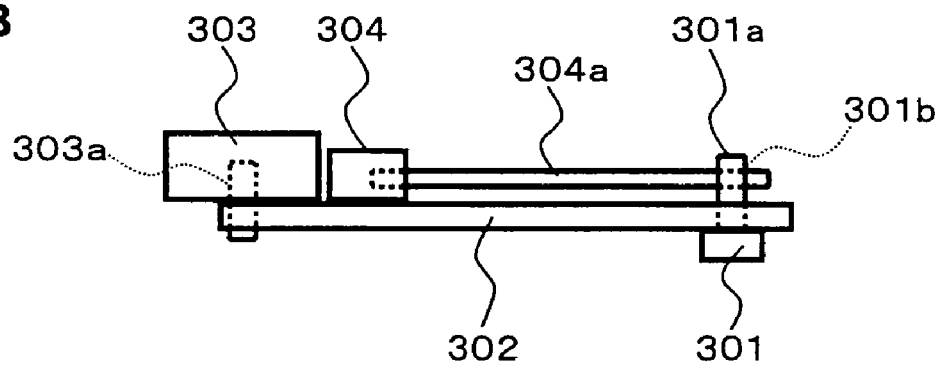
FIG. 17B is a schematic side view illustrating the exemplary structure for making the laser displacement meter scan in the road surface state measuring system according to the modified example of the embodiment of the present invention.

FIG. 17A is a bottom view seen from the bottom side (the side of the road surface) of a structure for making a laser displacement meter 301 scan. FIG. 17B is a side view of the structure seen from the side (in a direction parallel with the road surface). The structure illustrated in the figures corresponds to the one illustrated in FIG. 2 of the above-described embodiment. The structure illustrated in FIGS. 17A and 17B is housed in the measurement body portion 10 (see FIG. 1), and is made to descend to a position near the road surface by an elevator mechanism as illustrated in FIG. 5 to be made available for use in the measurement.

The laser displacement meter 301 is attached to an arm 302 provided substantially in parallel with the road surface. One end of the arm 302 is attached to a rotating mechanism 303 via a rotating shaft 303*a*. The rotating mechanism 303 is provided with an actuator (such as a motor) for rotating the rotating shaft 303*a*. The rotating mechanism 303 works such that the driving force of the actuator rotates the arm 302 about the rotating shaft 303*a*.

The arm 302 and the rotating mechanism 303 which work as described above constitute an example of the "main scanning means" of the present invention for moving the laser displacement meter 301 in the circumferential direction substantially in parallel with the road surface.

An arm 302 has an opening 302*a* formed therein along its longitudinal direction (radial direction orthogonal to the rotating direction by the rotating mechanism 303). A holding portion 301*a* extending upward is provided on the upper side of the laser displacement meter 301. The holding portion 301*a* is provided so as to be inserted through the opening 302*a* of the arm 302 from the bottom side to the top side. An opening 301*b* is formed in the holding portion 301*a* of the laser displacement meter 301 above the arm 302 along the longitudinal direction of the arm 302.

A further rotating mechanism 304 is attached to a position on a top face side of the upper arm 302 near the rotating mechanism 303. An end of a rotating shaft 304*a* is connected to the rotating mechanism 304. A built-in actuator (such as a motor) drives the rotating shaft 304*a* to rotate. The rotating shaft 304*a* is provided along the longitudinal direction of the arm 302. The other end of the rotating shaft 304*a* is inserted through the opening 301*b* in the holding portion 301*a* of the laser displacement meter 301.

The surface of the rotating shaft 304*a* is threaded such that the rotating shaft 304*a* functions as a ball screw. The opening 301*b* of the holding portion 301*a* of the laser displacement meter 301 functions as a female thread to engage with the rotating shaft 304*a* as the ball screw. With such a structure, when the rotating mechanism 304 rotates the rotating shaft 304*a*, the laser displacement meter 301 is moved along the longitudinal direction of the arm 302. The direction of the movement of the laser displacement meter 301 is switched according to the direction of rotation of the rotating shaft 304*a*.

The arm 302 and the rotating mechanism 304 which work as described above constitute an example of the "sub scanning means" of the present invention for moving the laser displacement meter 301 in the radial direction orthogonal to the circumferential direction.

The operations of the rotating mechanisms 303 and 304 are respectively controlled by controlling means such as a microprocessor, for example, the CPU 21 as shown in FIG. 7 in the above-described embodiment.

Scanning modes of the measuring means in the road surface state measuring system of this modified example having the above-described structure is now described.

(First Scanning Mode)

In a first scanning mode, the measuring means scans concentrically. In order to attain this, first, the CPU 21 controls the rotating mechanism 304 to position the laser displacement meter 301 at a first scanning position with respect to the arm 302. The first scanning position is, for example, a position near an outer end of the arm 302 (an end opposite to the side of the rotating shaft 303*a*).

Then, the CPU 21 controls the rotating mechanism 303 to rotate the arm 302 in the circumferential direction with the laser displacement meter 301 fixed at the first scanning position. Here, the laser displacement meter 301 continuously measures the distance to the road surface at predetermined measurement intervals. Accordingly, the laser displacement meter 301 obtains a measurement data column on a measuring line along a circle C1. A radius (r1) of the circle C1 is the distance between the first scanning position and the rotating shaft 303*a* and a center of the circle C1 is the rotating shaft 303*a*.

Next, the CPU 21 controls the rotating mechanism 304 to move the laser displacement meter 301 to a second scanning position. The second scanning position is, for example, a position which is away from the first scanning position toward the rotating shaft 303*a* by a predetermined distance. The CPU 21 controls the rotating mechanism 303 to rotate the arm 302 in the circumferential direction with the laser displacement meter 301 fixed at the second scanning position. Here, the laser displacement meter 301 continuously measures the distance to the road surface at predetermined measurement intervals. Accordingly, the laser displacement meter 301 obtains a measurement data column on a measuring line along a circle C2. A radius (r2) of the circle C2 is the distance between the second scanning position and the rotating shaft 303*a* and a center of the circle C2 is the rotating shaft 303*a*.

By repeatedly carrying out such measurement, a measurement data column on a measuring line along a circle Ci is obtained. A radius (r1) of the circle Ci is the distance between the i-th scanning position and the rotating shaft 303*a* and a center of the circle Ci is the rotating shaft 303*a* (i=1–N). The N circles C1–CN are concentric circles and the common center of the concentric circles is the rotating shaft 303*a*.

(Second Scanning Mode)

In a second scanning mode, the measuring means scans spirally. In order to attain this, first, the CPU 21, controls the rotating mechanism 304 to position the laser displacement meter 301 at a predetermined scanning start position. The scanning start position is, for example, a position near an outer end of the arm 302.

Then, the CPU 21 controls the rotating mechanism 303 to rotate the arm 302 at a predetermined rotational speed, and at the same time, controls the rotating mechanism 304 to move the laser displacement meter 301 at a predetermined moving speed from the scanning start position (toward the rotating shaft 303*a*). Here, the laser displacement meter 301 continuously measures the distance to the road surface at predetermined measurement intervals. By this, the laser displacement meter 301 obtains a measurement data column on a spiral measuring line with the radius of rotation being gradually decreased starting from the scanning start position.

[Operation and Effect]

Operations and effects of this modified example materializing the scanning modes are as follows.

According to the above-described first scanning mode, similarly to the above-described embodiment, since measurement data columns on a plurality of concentric measuring lines can be obtained with respect to a measurement region on a road surface, the reliability of texture estimation of the road surface can be improved.

According to the second scanning mode, since a measurement data column on a spiral measuring line can be obtained with respect to a measurement region on a road surface, compared with a conventional scanning mode described in Patent Literature 2 where measurement is carried out along a single circumference, the measurement range can be wider. Therefore, the reliability of texture estimation of the road surface can be improved.

It is to be noted that the structure illustrated in FIG. 17 is only an example of the main scanning means and the sub scanning means. Any structure which can move the measuring means in the circumferential direction substantially in parallel with the road surface can be applied as the main scanning means in this modified example. Further, any structure which can move the measuring means in the radial direction (sub scanning direction) orthogonal to the circumferential direction (main scanning direction) of scanning by the main scanning means can be applied as the sub scanning means in this modified example.

Further, the various kinds of structures of the embodiments described above can be applied to this modified example. For example, a structure can be applied where an acceptable range of the texture scores is stored, it is decided whether calculated texture scores are within the acceptable range or not, and a notification is made that the calculated texture scores are decided to be outside the acceptable range. Here, it is preferable that acceptable ranges of a plurality of kinds of texture scores such as mean profile depths, accumulated extension ratios of asperities, and contact portion ratios are stored and a decision is made with respect to each of the plurality of kinds of the texture scores whether the result of calculation is within the acceptable range or not.

[Supplementary Note]

Other characteristics provided to the above-described embodiment are described in the following.

<Supplementary Claim 1>

A road surface state measuring system according to claim 6 to 9, wherein:

the principal driving means includes a stepping motor; and the principal guiding means includes a rail a longitudinal direction thereof being the main scanning direction, a ball screw provided along the longitudinal direction of the rail, one end of the ball screw being connected to a rotating shaft of the stepping motor, and a mounting member for attaching the measuring means thereto, the mounting member having a female thread for engaging with the ball screw to be moved in the main scanning direction according to rotation of the ball screw driven by the stepping motor.

<Supplementary Claim 2>

A road surface state measuring system according to claim 10 to 13 wherein:

the auxiliary driving means includes a stepping motor;

the auxiliary guiding means has a rail a longitudinal direction thereof being the sub scanning direction, a ball screw provided along the longitudinal direction of the rail, one end of the ball screw being connected to a rotating shaft of the stepping motor, and a mounting member for attaching the measuring means thereto, the mounting member having a female thread for engaging with the ball screw to be moved in the sub scanning direction according to rotation of the ball screw driven by the stepping motor.

<Supplementary Claim 3>

A road surface state measuring system according to any one of claims 1 to 19, wherein the measuring means includes a laser displacement meter.

<Supplementary Claim 4>

A road surface state measuring system according to any one of claims 1 to 19, further including elevator means for vertically moving the measuring means.

The "elevator means" in Supplementary claim 4 includes, for example, the elevator mechanism 50A as illustrated in FIG. 5.

What is claimed is:

1. A road surface state measuring system comprising:

a measuring means for measuring a distance to road surface;

a scanning means for moving the measuring means to scan measurement positions of the distance to the road surface; the scanning means having a main scanning means and a sub scanning means; the scanning means moving the measuring means two-dimensionally;

the main scanning means moving the measuring means in a predetermined main scanning direction to scan the measurement position;

the sub scanning means moving the measuring means in a sub scanning direction orthogonal to the main scanning direction; and a calculating means for calculating texture scores used for estimating texture of the road surface based on a measurement data column of the distance to the road surface obtained by the moved measuring means, wherein the sub scanning means moves the position of the measuring means in the sub scanning direction; and the measuring means obtains a plurality of the measurement data columns corresponding to a plurality of positions in the sub scanning direction by continuously measuring the distance at predetermined measurement intervals when the measuring means is moved in the main scanning idrection by the main scanning means at the changed position and by obtaining measurement data column corresponding to the changed position.

2. A road surface state measuring system according to claim 1, wherein the calculating means divides the plurality of measurement data columns obtained by the measuring means into a plurality of subdata columns; the calculating means calculates the texture scores with regard to the subdata columns; and the calculating means calculates a mean value of the texture scores with regard to the subdata columns.

3. A road surface state measuring system according to claim 2, wherein the main scanning means comprises:

a principal driving means for driving the measuring means and a principal guiding means for guiding the driven measuring means in the main scanning direction.

4. A road surface state measuring system according to claim 2, wherein the sub scanning means comprises:

an auxiliary driving means for driving the measuring means and an auxiliary guiding means for guiding the driven measuring means in the sub scanning direction.

5. A road surface state measuring system according to claim 1, wherein the calculating means calculates the texture scores with regard to the plurality of measurement data columns obtained by the measuring means, and calculates a mean value of the texture scores.

6. A road surface state measuring system according to claim 5, wherein the main scanning means comprises:

a principal driving means for driving the measuring means and a principal guiding means for guiding the driven measuring means in the main scanning direction.

7. A road surface state measuring system according to claim 5, wherein the sub scanning means comprises:

an auxiliary driving means for driving the measuring means and an auxiliary guiding means for guiding the driven measuring means in the sub scanning direction.

8. A road surface state measuring system according to claim 1, wherein the main scanning means comprises:

a principal driving means for driving the measuring means and a principal guiding means for guiding the driven measuring means in the main scanning direction.

9. A road surface state measuring system according to claim 1, wherein the sub scanning means comprises:

an auxiliary driving means for driving the measuring means and an auxiliary guiding means for guiding the driven measuring means in the sub scanning direction.

10. A road surface state measuring system according to claim 1, wherein the sub scanning means comprises:

an auxiliary driving means for driving the measuring means and an auxiliary guiding means for guiding the driven measuring means in the sub scanning direction.

11. A road surface state measuring system according to claim 1, wherein the main scanning means moves the measuring means in a circumferential direction, substantially in parallel with the road surface; and the sub scanning means moves the measuring means in a radial direction orthogonal to the circumferential direction.

12. A road surface state measuring system according to claim 11, wherein the measuring means changes its position in the radial direction by the sub scanning means, and the measuring means obtains a plurality of the measurement data columns along concentric (concentric-circle-like) measurement lines by measuring the distance at predetermined measurement intervals when the measuring means is moved in the circumferential direction by the main scanning means at the changed position and by obtaining the measurement data column corresponding to the changed position.

13. A road surface state measuring system according to claim 11, wherein the measuring means obtains the measurement data column along a spiral measurement line by measuring the distance at predetermined measurement intervals when the measuring means is moved in the circumferential direction by the main scanning means at predetermined speed and by obtaining the measurement data column.

14. A road surface state measuring system according to claim 13, wherein the plurality of kinds of texture scores include at least one of mean profile depth, accumulated extension ratio of asperities, and contact portion ratio.

* * * * *